US007669975B2

(12) United States Patent
Matsuzoe

(10) Patent No.: US 7,669,975 B2
(45) Date of Patent: Mar. 2, 2010

(54) DISCHARGE CONTROL UNIT, METHOD FOR CONTROLLING DISCHARGE OF THE SAME, AND METHOD FOR PRODUCING THE SAME

(75) Inventor: Hisanobu Matsuzoe, Fukuoka (JP)

(73) Assignees: Fukuoka Technoken Kogyo, Co., Ltd., Fukuoka (JP); Kobayashi Create Co., Ltd., Aichi-ken (JP)

( * ) Notice: Subject to any disclaimer, the term of this patent is extended or adjusted under 35 U.S.C. 154(b) by 671 days.

(21) Appl. No.: 10/581,673

(22) PCT Filed: Dec. 10, 2004

(86) PCT No.: PCT/JP2004/018514

§ 371 (c)(1),
(2), (4) Date: Jun. 5, 2006

(87) PCT Pub. No.: WO2005/056297

PCT Pub. Date: Jun. 23, 2005

(65) Prior Publication Data

US 2007/0085041 A1 Apr. 19, 2007

(30) Foreign Application Priority Data

Dec. 12, 2003 (JP) ..... 2003-414227
Feb. 3, 2004 (JP) ..... 2004-027017

(51) Int. Cl.
*B41J 2/05* (2006.01)
*B41J 29/38* (2006.01)

(52) U.S. Cl. ..... 347/56; 347/9

(58) Field of Classification Search ..... 347/9, 347/56, 61

See application file for complete search history.

(56) References Cited

FOREIGN PATENT DOCUMENTS

JP 2003-249327 9/2003
JP 2003-326756 11/2003

OTHER PUBLICATIONS

The Institute of Image Electronics Engineers of Japan, 1982, p. 364-369, vol. 11 (5), Japan.

*Primary Examiner*—An H Do
(74) *Attorney, Agent, or Firm*—Jean C. Edwards, Esq.; Akerman Senterfitt

(57) ABSTRACT

A discharge control unit controls discharge from a discharge electrode at low voltage, has a high density mounting based on downsizing of the discharge control portion eliminates electric leakage and has excellent discharge stability. The discharge control unit includes: a heating portion including at least one heat-generating body and driver ICs electrically connected to the heat-generating bodies and caused to generate heat by flowing an electric current to an optional point of one heat-generating body or selectively flowing the same to a plurality of heat-generating bodies; and a heat generation portion insulating film covered on at least the heat-generating bodies; and discharge electrodes, to which voltage is applied, disposed at the heat generation portion insulating film so as to correspond to the heat-generating bodies; wherein discharge is carried out from discharge portions of the discharge electrodes selectively heated by the heat-generating bodies.

26 Claims, 10 Drawing Sheets

DISCHARGE CONTROL UNIT, METHOD FOR CONTROLLING DISCHARGE OF THE SAME, AND METHOD FOR PRODUCING THE SAME

CROSS-REFERENCE TO RELATED APPLICATIONS

The present application is a 37 C.F.R. 371 national stage entry of International Patent Application No. PCT/JP2004/018514, filed Dec. 10, 2004, which claims priority from Japanese Patent Applications Nos. JP 2003-414227, filed Dec. 12, 2003, and JP 2004-027017, filed Feb. 3, 2004, the contents of which are herein incorporated by reference in their entirety.

BACKGROUND OF THE INVENTION

1. Field of the Invention

The present invention relates to a discharge control unit that is capable of being preferably used for an ion projection unit in an atmosphere in which ions can be generated, and capable of controlling ultraviolet ray projection in a plasma state in an inactive gas atmosphere and discharge of thermoelectrons in a vacuum state, a method for controlling discharge of the same, and a method for producing the same.

2. Description of the Related Art

In recent years, an electrostatic latent image forming system based on an ion projection system which is different from an electrophotography system has been developed (For example, refer to The Institute of Image Electronics Engineers of Japan, Journal Vol. 11, No. 5 (1982), Pages 364 through 369).

Although, in the electrophotography system, an electrostatic latent image is formed on a photosensitive body operating as an image carrier in compliance with two processes consisting of uniform electrification and exposure, the ion projection system is capable of completing formation of an electrostatic latent image by selectively electrifying (electrifying for formation of an electrostatic latent image) an image carrier (the carrier may be any insulative body, which is not necessarily a photosensitive body) only by one process of projection of ions generated in line with discharge from a discharge electrode in an atmosphere in which ions can be generated. Therefore, the ion projection system is a further simplified electrostatic latent image formation system.

For example, in an electrostatic plotter of an ion projection system, a discharge control unit controls ON and OFF of discharge is emitted, projects ions by carrying out discharge from a needle electrode operating as a discharge electrode, and forms an electrostatic latent image on an electrostatic recording sheet of paper whose surface is made insulative.

In a prior art discharge control unit used for the electrostatic plotter, high voltage of several kVpp is selectively applied to respective discharge electrodes (needle electrodes) by a discharge control portion, and discharge is brought about. In order to control ON and OFF of the discharge, a driver IC to cope with high voltage (for example, the control is carried out at 300V through 1000V in a positive or negative state) is employed.

However, there is a problem in that, since it is necessary to widen the spacing of respective discharge electrodes (needle electrodes) to which high voltage is applied, the discharge electrode portion is made large-sized. Also, in order to apply high voltage to the respective driver ICs, it is necessary to secure sufficient distances for the spacing along which the driver ICs are disposed, and for the spacing between lead patterns extending from the respective driver ICs. Therefore, there is another problem in that the discharge control portion is made large-sized. In addition, since the driver IC to cope with high voltage is expensive, there is still another problem in that the discharge control unit and an image forming apparatus employing the same are necessarily made expensive.

An ion generation unit having a discharge electrode and an induction electrode between which a dielectric intervenes, in which pulse waveform voltage of either one of a positive or a negative polarity is applied between the discharge electrode and the induction electrode, according to Japanese Unexamined Patent Publication No. 2003-249327 that has been invented and filed by the present applicant et. al., is capable of applying voltage only with a single power source, is inexpensive, and does not use any alternate current. Therefore, since a current flowing in the dielectric becomes very slight, the consumption power can be reduced, and ions can be generated with comparatively small voltage, wherein the unit brings about excellent actions and effects by which an inexpensive power source having slight consumption power can be used. However, the ion generation unit uniformly electrifies and de-electrifies the entire surface of a photosensitive body and a dielectric of an electrophotography recording unit and an electrostatic recording unit. Therefore, the unit cannot be used as a print head as it is.

Provisionally, if the ion generation unit according to Japanese Unexamined Patent Publication No. 2003-249327 is used as a print head, it is necessary that the discharge electrode is completely divided into a plurality, and discharge can be selectively carried out from the respective discharge electrodes. As a result, problems similar to those of the discharge control unit used for the above-described electrostatic plotter occur.

In order to solve these problems, Japanese Unexamined Patent Publication No. 2003-326756 that the applicant filed after whole-hearted research, discloses an ion generation unit for controlling generation of ions based on control of the temperature of a discharge electrode portion, in which a discharge electrode and an induction electrode are disposed with a dielectric intervened therebetween, an heat-generating element is provided to cope with the discharge electrode, the temperature of the discharge electrode is controlled, adequate high voltage is applied between the discharge electrode and the induction electrode, and discharge of the discharge electrode is controlled by heating of the heat-generating element.

SUMMARY OF THE INVENTION

According to the technology disclosed in Japanese Unexamined Patent Publication No. 2003-326756, it is not necessary to directly control ON and OFF of high voltage applied onto the respective discharge electrodes, and it is possible to control generation of ions by controlling an heat-generating element, which controls the temperature of the respective discharge electrodes, at low voltage. Therefore, a driver IC to cope with low dielectric strength can be used as the driver IC for the heat-generating element, wherein the technology according to Japanese Unexamined Patent Publication No. 2003-326756 has excellent actions and effects by which high density mounting is carried out by narrowing the interval in which the respective driver ICs are disposed and the interval of lead patterns extending from the respective driver ICs, and downsizing of the discharge control portion can be made the aim, and simultaneously a decrease in the costs of the discharge control portion can be made the aim by employing inexpensive and versatile articles as the driver ICs. However, it is highly desired that stability of discharge actions and energy saving performance are improved along with mounting at higher density and improvement in mass productivity based on a further simplified structure, and unevenness in discharge directions is reduced.

The present invention solves the problems in the prior arts, and it is therefore an object of the invention to provide a discharge control unit capable of controlling discharge from a discharge electrode at low voltage, aiming at achieving high density mounting and a decrease in costs based on downsizing of the discharge control portion, and simultaneously having excellent stability of discharge control in such conditions that leakage hardly occurs, to provide a method for controlling discharge of the discharge control unit, which is capable of efficiently carrying out discharge, excellent in energy saving performance, and simultaneously has an excellent long service life of the discharge electrodes, and to provide a method for producing the discharge control unit, to which the existing production facilities can be diverted, being excellent in versatility, capable of simplifying the production processes and excellent in mass productivity.

In order to solve the objects, a discharge control unit, a method for controlling discharge, and a method for producing the discharge control unit according to the invention include the following constructions.

A discharge control unit according to a first aspect of the invention is constructed so that it includes: a heating portion including one or a plurality of heat-generating bodies and driver ICs electrically connected to said one or a plurality of heat-generating bodies and caused to generate heat by flowing an electric current to an optional point of said one heat-generating body or selectively flowing the same to said plurality of heat-generating bodies; and a heat generation portion insulating film covered on at least said heat-generating bodies; and discharge electrodes, to which voltage is applied, disposed at said heat generation portion insulating film so as to correspond to said one or a plurality of heat-generating bodies; wherein said discharge electrodes are formed to be like a flat plate, which is rectangular or square, so as to have a common electrode portion and discharge portions, discharge is carried out from said discharge portions of said discharge electrodes selectively heated by said heat-generating bodies.

With such a construction, the following actions are included.

(1) Since the heating portion includes one or a plurality of heat-generating bodies and driver ICs electrically connected to one or a plurality of heat-generating bodies and caused to generate heat by flowing an electric current to an optional point of one heat-generating body or selectively flowing the same to a plurality of heat-generating bodies, optional point (discharge portions) of discharge electrodes, disposed to correspond to one or a plurality of heating portions via the heat generation portion insulating film covering the heat-generating bodies, to which voltage is applied, are selectively heated, thereby generating discharge.

(2) By heating the optional point of the discharge electrodes to which high voltage is applied, by means of the heat-generating bodies of the heating portion, thermoelectrons are discharged from the discharge portions of the selectively heated discharge electrodes, and at the same time, discharge is caused to occur, wherein it is possible to project ions in an atmosphere where ions can be generated. In addition, if discharge occurs in an atmosphere of an inactive gas such as xenon gas or neon gas which permits to generate only a slight amount of ions, a plasma state is brought about, wherein it is possible to project an ultraviolet ray, and thermoelectrons can be emitted like an electron gun in a vacuum state where no ions can be generated.

(3) Since at least the heat-generating bodies are covered with the heat generation portion insulating film, the discharge electrode to which high voltage is applied and the heat-generating body can be insulated from each other, and simultaneously heat generated by the heat-generating body is transmitted to the discharge electrode, an optional point of the discharge electrode corresponding to the heat-generating body that generates heat can be heated, thereby generating discharge.

(4) Since discharge can be generated from an optional point of the discharge electrode selectively heated by the heat-generating body, minute positional matching between the heat-generating body and the discharge electrode is not required, wherein excellent assembling efficiency can be secured, and it is possible to form the discharge electrode like a flat plate which is rectangular or square, etc. Accordingly, excellent mass productivity can be brought about.

(5) Where the heat-generating body is disposed so as to be stretched over the edge parts of the discharge electrode that has been formed to be a rectangular or square flat plate, discharge can be efficiently generated from the edge part where the amount of discharge is large.

(6) By controlling the heating time of the discharge electrode by the heat-generating body of the heating portion, it is possible to control the discharge time at the discharge portion of the discharge electrode, and it is possible to control the amount of generation of ions from the discharge portion.

(7) Since the amount of generation of ions can be controlled only by controlling the heating time for the discharge electrode by the heating portion, it becomes possible to easily carry out area gradation on an image carrier, to which ions are projected, in an image forming apparatus of an electrostatic latent image forming system, wherein the image quality can be improved.

Herein, aluminum and gold may be preferably employed as the material of the discharge electrode. Since high voltage is applied to the discharge electrode, and at the same time, generation of discharge can be controlled by heating, it is possible to easily generate discharge at an optional point (discharge portion) of the discharge electrode by selecting a heating point by the heat-generating body, wherein flexibility in the shape of the discharge electrode is excellent.

It is preferable that the thickness of the discharge electrode is 5 μm through 100 μm where it is made of aluminum. As the thickness of the discharge electrode becomes thinner than 5 μm, the discharge electrode is easily subjected to influence by wear, and there is a tendency that the service life of the discharge electrode is shortened, and as the thickness becomes thicker than 100 μm, the thermal conductivity is lowered, and there is a tendency that responsiveness to ON and OFF of heating is easily worsened. Such tendencies are not preferable.

Also, where the end portion at the side facing the heat-generating body is divided to be like comb teeth, corresponding to the heating portion of the heat-generating body, and individual discharge electrode portions are formed since the amount of discharge of the discharge electrode from the edge periphery thereof is greater than from the other parts, the peripheral length of the edge periphery can be made longer. By increasing the amount of discharge from the discharge electrode, it is possible to increase the amounts of projected electrons, ions, and ultraviolet rays, wherein energy saving performance and efficiency of the discharge control unit are excellent. Further, since the voltage applied to the discharge electrode can be set to be low, a longer service life of the discharge electrode can be secured.

Instead of forming individual discharge electrode portions by dividing the end portion of the discharge electrode, individual discharge pore portions may be formed, corresponding to the heating position of the heat-generating body. Thereby, discharge easily occurs from the edge periphery of the individual discharge pore portions, and actions which are similar to those of the individual discharge electrode portions can be obtained. The individual discharge pore portions may be formed in various shapes which are roughly circular, roughly elliptical, polygonal such as quadrangular, hexagonal, and star-like. Also, the number and size of individual discharge pore portions per discharge portion (in the vicinity of the heating position) may be adequately selected and combined.

The heating portion may be such that an optional point of a single heat-generating body or a plurality of heat-generating bodies can be selectively caused to generate heat. By electrically connecting the heat-generating body by an electrode that is formed to such a pattern like comb teeth or in the form of a matrix, it is possible to selectively cause an electric current to flow to an optional point of a single heat-generating body or a plurality of heat-generating bodies and to cause the same to generate heat. Such a construction which is similar to a thermal printer head used for a conventional photosensitive type facsimile may be preferably employed for the heating portion. Where the discharge electrode is formed to be a flat plate which is rectangular and square, etc., a plurality of heat-generating bodies electrically connected to each other by means of comb teeth-shaped electrodes may be juxtaposed to each other, or a single heat-generating body electrically connected by an electrode formed in the form of a matrix may be disposed. At this time, by disposing electrodes connected to the heat-generating bodies in chessboard patterns, it is possible to easily aim at improving the resolution and recording speed in an image forming apparatus.

$TaSiO_2$ and $RuO_2$ may be preferably employed as the heat-generating body.

The heat generation portion insulating film is formed for protection and insulation of the heat-generating bodies and the electrodes connected to the heat-generating bodies. A substance of the heat generation portion insulting film having high thermal conductivity, by which heat of the heat-generating bodies can be efficiently transmitted to the discharge electrodes, is preferable, wherein synthetic resins having heat resistance, such as polyimide and aramid, etc., may be preferably employed in addition to SiAl, $SiO_2$, SiC, lead glass, mica, etc. Also, the heat generation portion insulating film is formed by screen-printing, evaporation, spattering, etc.

Where the heating generation portion insulating film is formed of glass, it is favorable that the thickness thereof is 2 μm through 50 μm, preferably 4 μm through 40 μm. As the thickness of the heat generation portion insulating film becomes thinner than 4 μm, there is a tendency that the insulation property is easily lowered, and as the thickness thereof becomes thicker than 40 μm, it is necessary to increase the voltage applied to the discharge electrode and the amount of heat generation of the heat-generating body, wherein there is a tendency that energy saving performance thereof is easily lowered. In particular, as the thickness of the heat generation portion insulating film becomes thinner than 2 μm, the surface of the heat-generating body and the electrode connected to the heat-generating body cannot be completely covered, and pinholes easily occur, wherein there is a tendency that reliability may be lost. And, as the thickness thereof becomes thicker than 50 μm, stability of discharge is easily lowered, and there is a tendency that mass productivity is worsened. Such tendencies are not preferable. Where the thickness of the heat generation portion insulating film is 2 μm through 50 μm, preferably 4 μm through 40 μm, the insulation property and thermal conductivity are well balanced, both of them are satisfactory, and excellent discharge stability can be secured.

The driver IC of the heating portion is disposed as a discharge control portion (switch portion) for controlling the presence or absence of that the discharge electrode is heated, by selectively causing an electric current to flow to an optional point of a single heat-generating body or a plurality of heat-generating bodies and selectively causing the same to generate heat. It is sufficient that the voltage applied to the heat-generating body is a low voltage, for example, 24V, an inexpensive and versatile driver IC which is driven with, for example, 5V and corresponds to low dielectric strength can be used as the driver IC described above, wherein it is possible to reduce the costs of the discharge control portion.

In addition, by employing a driver IC for low dielectric strength, the driver IC itself can be downsized, and radiation from the driver IC can be reduced, and at the same time, it is possible to narrow the disposed interval of respective driver ICs and the interval of lead patterns extending from the respective driver ICs, wherein high density mounting is enabled, and it is possible to aim at downsizing the discharge control portion.

Since it is possible to control discharge in terms of its presence and absence by controlling heating of the discharge electrode by a heat-generating body, the pitch of discharge generation is regulated by the pitch of electrode patterns for electric connections of the heat-generating body. Therefore, if the pitch of electrode patterns is made minute and the electrodes are mounted in high density, it is possible to make the pitch of discharge generation small, wherein it is possible to form an image at high resolution if the discharge control unit is employed as a print head of an image forming apparatus. In addition, the resolution can be easily varied only by changing the pitch of electrode patterns, wherein freedom in design can be increased, and excellent productivity can be secured.

By grounding the side of the image carrier (a carrier of an electrostatic latent image such as electrostatic recording paper, etc.,) although not being provided with an induction electrode as a prior art ion generation unit, ions can be directly concentrated and projected from the discharge electrode to the image carrier, and efficiency is excellent. Accordingly, the unit dot of the image forming apparatus can be made minute, and at the same time, accuracy of projection position can be improved, wherein a highly minute recording can be carried out. Furthermore, since no induction electrode is required, productivity is excellent, and simultaneously, the discharge control unit can be downsized, wherein high-density mounting can be achieved, and it is possible to aim at achieving high resolution of the image forming apparatus.

Also, the discharge electrodes are formed to be like a flat plate, and can be formed like a plurality of needles. In this case, by disposing heat-generating bodies at the outer circumference of the needle-shaped discharge electrodes via a heat generation portion insulating film, the discharge electrodes are heated, and discharge can be generated. By forming the discharge electrodes like needles, mounting density can be improved, the discharge control unit can be downsized, and simultaneously, the resolution of the image forming apparatus can be increased.

A discharge control unit according to a second aspect of the invention comprises: a heating portion including one or a plurality of heat-generating bodies and driver ICs electrically connected to said one or a plurality of heat-generating bodies and caused to generate heat by flowing an electric current to an optional point of said one heat-generating body or selectively flowing the same to said plurality of heat-generating bodies; and a heat generation portion insulating film covered on at least said heat-generating bodies; and discharge electrodes, to which voltage is applied, disposed at said heat generation portion insulating film so as to correspond to said one or a plurality of heat-generating bodies; wherein said discharge electrodes include a plurality of individual discharge electrode portions and a common electrode portion, which connect one-sided ends of said plurality of individual discharge electrode portions and are formed to be wider than the width of said individual discharge electrode portions, and carry out discharge from the discharge portions of said discharge electrodes selectively heated by said heat-generating bodies.

With such a construction, the following actions are included.

(1) Since the discharge electrodes are provided with a plurality of individual discharge electrode portions and a common electrode portion for connecting one-sided ends of the plurality of individual discharge electrode portions, it is possible to simultaneously apply voltage to the plurality of individual discharge electrode portions via the common electrode portion.

(2) By dividing a part of the discharge electrodes into a plurality of individual discharge electrode portions, the peripheral length of the edge peripheries of the respective individual discharge electrode portions corresponding to the heat-generating bodies can be lengthened, wherein discharge from the individual discharge electrode portions can be facilitated, excellent discharge stability is ensured, the discharge amount is increased, and the amount of projection of electrons, ions, ultraviolet rays can be increased. Therefore, excellent energy saving performance and excellent efficiency are achieved.

(3) Since the width of the common electrode portion is formed to be wider than the width of the individual discharge electrode portion, the cooling effect of the individual discharge electrode portions that are temporarily heated to 200 through 300 c. can be improved, it is possible to prevent heat from being confined, wherein discharge can be quickly stopped in response to OFF of the heating, and the interval of discharge time can be shortened. Discharge and non-discharge can be changed over in a short time.

(4) By forming the width of the common electrode portion wider and widening the area, it is possible to lower the resistance value of the common electrode portion, and the potential difference brought about between the respective individual discharge electrode portions connected to each other by the common electrode portion can be suppressed as much as possible. Therefore, unevenness in the discharge amount in the respective individual discharge electrode portions can be reduced, and stability of discharge can be improved.

Herein, the individual discharge electrode portions and the common electrode portion can be simultaneously formed by etching of gold film. It is possible to easily vary the number and shape of the individual discharge electrode portions and the common electrode portion without increasing the number of processes only by changing the pattern of a mask.

The individual discharge electrode portions can be shaped to be roughly rectangular, trapezoidal, semi-circular, or formed in a combined shape thereof. In addition, the individual discharge electrode portions are divided by slits and are caused to have recesses and projections at the peripheral portion thereof, wherein it is possible to further increase the peripheral length of the edge periphery of the individual discharge electrode portions.

Further, the above-described individual discharge pore portions may be formed at the individual discharge electrode portions, wherein discharge is generated from the edge peripheries of the individual discharge pore portions in addition to the outer edge peripheries of the individual discharge electrode portions, and the energy saving performance can be further improved.

The width of the common electrode portion can be adequately established in compliance with the width and number of the individual discharge electrode portions. Since the common electrode portion can have a sufficient area with respect to the total area of the individual discharge electrode portion, influence due to the resistance value of the common electrode portion can be reduced, and it is possible to suppress the potential difference between the individual discharge electrode portions.

A discharge control unit according to a third aspect of the invention includes a construction, in addition to the discharge control unit according to the second aspect, in that said individual discharge electrode portions of said discharge electrode are provided with split electrodes divided into a plurality.

With such a construction, the following action is included in addition to the actions according to the second aspect of the invention.

(1) By dividing the individual discharge electrode portions of the discharge electrode into a plurality and forming split electrodes, the outer peripheral length of the individual discharge electrode portions can be lengthened, wherein the discharge amount from the edge periphery of the individual discharge electrode portions can be increased, and it is possible to increase the amount of projection of electrons, ions and ultraviolet rays.

Herein, the individual discharge electrode portions can be divided into a plurality by slits. The direction of dividing the individual discharge electrode portions may be parallel to the lengthwise direction or orthogonal thereto. Also, the split electrodes may be formed by dividing the entirety of the individual discharge electrode portions or may be formed by partially dividing the edge portions of the individual discharge electrode portions. The summed outer peripheral length of the respective split electrodes is increased to a large extent in comparison with the outer peripheral length of a non-divided single individual discharge electrode portion, wherein the discharge amount from the edge periphery, from which the discharge amount is great, can be efficiently increased. Therefore, the application voltage applied to the discharge electrode can be set to be low, and it is possible to aim at making longer the service life of the discharge electrode.

The split electrodes can be easily formed simultaneously with the individual discharge electrode portions without increasing the number of processes only by changing the mask pattern.

A discharge control unit according to a fourth aspect of the invention includes a construction, in addition to the discharge control unit according to the second aspect or the third aspect, in that said plurality of individual discharge electrode portions are disposed in chessboard patterns.

With such a construction, the following actions are included in addition to the actions of the second aspect or the third aspect of the invention.

(1) Since, by disposing a plurality of individual discharge electrode portions in chessboard patterns, the minimum pitch can be narrowed by interpolation based on the individual discharge electrode portions of a plurality of rows adjacent to each other without changing the basic pitch between the respective individual discharge electrode portions formed in the same rows, it is possible to mount a plurality of individual discharge electrode portions substantially at high density, wherein the resolution can be improved as the entirety of an image forming apparatus.

Herein, where a plurality of individual discharge electrode portions are disposed in chessboard patterns, rows of individual discharge electrode portions, each consisting of n rows, formed in the same basic pitch are disposed while being slipped by the step of 1/n of the basic pitch, and the minimum pitch can be made into 1/n of the basic pitch, wherein the resolution can be improved as an entirety.

Since a plurality of individual discharge electrode portions and heat-generating bodies can be formed at the same basic pitch, the processing can be facilitated, wherein mass productivity is excellent, and the yield can be improved.

Where the individual discharge electrode portions are disposed in chessboard patterns, a plurality of individual discharge electrode portions connected to each other by means of a single common electrode portion may be juxtaposed in a plurality of rows by the unit of a row, or a plurality of individual discharge electrode portions may be formed one row by one row at both sides of one common electrode portion. The common electrode portions of a plurality of juxtaposed rows may be independent or the end portions thereof may be connected to each other so that the juxtaposed common electrode portions become channel-shaped or comb teeth-shaped. In addition, as regards the heat-generating bodies, a plurality of the heat-generating bodies may be disposed in chessboard patterns so as to correspond to the individual discharge electrode portions, or heat-generating bodies formed to be band-shaped are connected by electrodes formed like comb teeth or in the form of a matrix, thereby heating the positions corresponding to the individual discharge electrode portions.

Further, by inclining and disposing the entire rows of individual discharge electrode portions and heat-generating bodies, which are formed at the basic pitch, the pitch of the arraying directions of the individual discharge electrode portions and heat-generating bodies projected in the horizontal direction can be further narrowed than the basic pitch, wherein high density mounting can be achieved without being subjected to any limitation in processing.

A discharge control unit according to a fifth aspect of the invention has a construction, in addition to the discharge control unit according to any one of the first aspect through the third aspect, in that said plurality of heat-generating bodies are disposed in chessboard patterns.

With such a construction, the following action is included in addition to the actions according to any one of the first aspect through the third aspect.

(1) By disposing a plurality of heat-generating bodies in chessboard patterns, it is possible to selectively heat the discharge portion of the discharge electrodes formed to be like a flat rectangular or square plate, wherein it is possible to simply improve the resolution and recording speed in an image forming apparatus.

Herein, by disposing n rows of heat-generating bodies formed with the same basic pitch while being slipped by 1/n the basic pitch where a plurality of heat-generating bodies are disposed in chessboard patterns, the minimum pitch can be made into 1/n the basic pitch, wherein it is possible to improve the entire resolution.

Since it is possible to form a plurality of heat-generating bodies with the same basic pitch, processing thereof can be facilitated, wherein excellent mass production performance can be secured with the yield thereof improved.

Also, by inclining and disposing the entire rows of the heat-generating bodies formed with the basic pitch, the pitch in the arraying direction of the heat-generating bodies projected in the horizontal plane can be further narrowed than the basic pitch, and it is possible to mount them at high density without any limitation in processing.

A discharge control unit according to a sixth aspect of the invention includes a construction, in addition to the discharge control unit according any one of the second aspect through the fifth aspect, in that said discharge electrode is provided with an auxiliary common electrode portion for connecting the other end portions of said plurality of individual discharge electrode portions.

With such a construction, the following action is included in addition to the actions according to any one of the second aspect through the fifth aspect of the invention.

(1) Since the discharge electrode is provided with an auxiliary common electrode portion for connecting the other ends of a plurality of individual discharge electrode portions, the heat radiation area combined with the common electrode portion is enlarged, wherein the cooling effect of the individual discharge electrode portions, responsiveness to turning-off of heating, and stability of discharge based on a lowering in the resistance value can be further improved.

Herein, the auxiliary common electrode portion supplements the shortage of the area of the common electrode portion, and the width thereof can be adequately selected by the width of the common electrode portion and the width and number of the individual discharge electrode portions. Also, the common electrode portion and the auxiliary common electrode portion may be independently formed, or may be connected to each other at one end thereof or at both ends thereof.

A discharge control unit according to a seventh aspect of the invention includes a construction, in addition to the discharge control unit according to any one of the first aspect through the sixth aspect, in that said discharge electrode includes said common electrode portion and said discharge portion and is provided with a conductive material layer formed on the surface of at least said common electrode portion of said discharge electrode.

With such a construction, the following action is included in addition to the actions according to any one of the first aspect through the sixth aspect.

(1) By forming a conductive material layer on the surface of at least the common electrode portion of the discharge electrode, the resistance value of the common electrode portion can be further lowered, and it is possible to securely reduce the potential difference occurring between the respective discharge portions, wherein stability of discharge is excellent.

Herein, any conductive material layer that includes further excellent conductivity than the discharge electrode may be accepted, and the conductive material layer may be easily formed by screen-printing of silver paste or silver plating. By increasing the thickness of the conductive material layer, it is possible to reduce the resistance value of the common electrode portion, and stability of discharge can be improved.

Where the discharge electrode is formed to be a rectangular or square flat plate, the part other than the discharge portion of the discharge electrode is made into the common electrode portion.

Where the discharge electrode is formed to be comb teeth-shaped, although the discharge electrode has a common electrode portion and individual discharge electrode portions, the conductive material layer may be formed not only at the common electrode portion but also at points other than the discharge portion of the individual discharge electrode portions.

Where the common electrode portion and auxiliary common electrode portion are formed at both ends of the individual discharge electrode portions of the discharge electrode, respectively, the conductive material layer may be formed at the auxiliary common electrode portion and at points other than the discharge portion of the individual discharge electrode portions.

Also, in any case, the conductive material layer may be formed on the entire width of the common electrode portion and the individual discharge electrode portions or may be formed only at a part thereof. In addition, the conductive material layer may be a single band-shaped member or may be a plurality of band-shaped members divided into two or more.

A discharge control unit according to an eighth aspect of the invention has a construction, in addition to the sixth aspect, in that the discharge control unit has a conductive material layer formed on the surface of at least said auxiliary common electrode in the discharge electrodes.

With such a construction, the following action is included in addition to the action of the sixth aspect.

(1) It is possible to further reduce the resistance value of the auxiliary common electrode portion and possible to securely reduce the potential difference occurred between the respective individual discharge electrodes.

A discharge control unit according to a ninth aspect of the invention includes a construction, in addition to any one of the first aspect through the eighth aspect, in that the discharge control unit is provided with an electrode protection thin film layer formed on the surface of said discharge electrode.

With such a construction, the following action is included in addition to any one of the first aspect through the eighth aspect of the invention.

(1) By forming the electrode protection thin film layer on the surface of the discharge electrode, it is possible to prevent wear on the surface of the discharge electrode from occurring due to impact when ions are generated in line with discharge, wherein the service life of the discharge electrode can be lengthened.

Herein, inorganic substances such as SiON, $SIO_2$, MgO, etc., may be preferably employed as the material of the electrode protection thin film layer. Spattering of the surface of the discharge electrode due to ions generated and deterioration of the discharge electrode due to oxidization can be prevented, and at the same time, creeping discharge can be prevented from occurring.

It is preferable that the thickness of the electrode protection thin film layer is 2 μm through 5 μm. As the thickness of the electrode protection thin film layer becomes thinner than 2 μm, it is impossible to securely cover the surface of the discharge electrode, wherein pinholes are apt to occur, and there is a tendency that the reliability is lost. As the thickness thereof becomes thicker more than 5 μm, it becomes difficult for discharge to occur, and there is a tendency that mass productivity is lost. Either case is not preferable. Spattering and evaporation may be preferably employed to form the electrode protection thin film layer.

A discharge control unit according to a tenth aspect of the invention includes a construction, in addition to the discharge control unit according to any one of the first aspect through the ninth aspect, in that the discharge control unit is provided with a coating film covered on said discharge electrode other than said discharge portion.

With such a construction, the following actions are included in addition to the actions according to any one of the first aspect through the ninth aspect of the invention.

(1) Since the coating film covered on the discharge electrode other than the discharge portion is provided, it is possible to prevent discharge from occurring from excess points other than the discharge portion of the discharge electrode, wherein it is possible to concentrate electrons, ions and ultraviolet rays at one point and to project the same thereto, and efficiency is excellent.

(2) By forming a coating film at parts other than the discharge portion of the discharge electrode, a stage difference can be formed between the surface of the discharge portion and the surface of the coating film. Therefore, it is possible to keep constant the stage difference between the discharge electrode and an image carrier (a carrier of an electrostatic latent image such as electrostatic recording paper, etc.) disposed opposite thereto, and it is possible to prevent contact with the discharge portion, wherein discharge from the discharge portion can be stabilized.

Herein, the coating film is formed of an insulative body similar to the above-described heat-generating portion insulating film and induction electrode insulating film, wherein glass, synthetic resins such as aramid, polyimide, etc., ceramic such as $SiO_2$, and mica may be preferably used.

The coating film has openings, which are formed to be roughly circular, roughly elliptical, or roughly rectangular, at the discharge portion of the discharge electrode (in the vicinity of the heat-generating body position). The openings are formed independently with respect to a plurality of discharge portions or may be continuously formed to be like a long slot.

A discharge control unit according to an eleventh aspect of the invention has a construction, in addition to the discharge control unit according to the tenth aspect, in that the discharge control unit is provided with recesses and projections formed on the surface of said coating film.

With such a construction, the following action is included in addition to the action according to the tenth aspect of the invention.

(1) By forming the recesses and projections on the surface of the coating film, the surface distance of the coating film can be lengthened to increase the surface resistance, and it is possible to prevent electric leakage from the points, at which discharge is generated, of the individual discharge electrode portions to the peripheries, and safety is excellent.

Herein, by forming the recesses and projections on the surface of the coating film and preventing electric leakage to the peripheries, a driver IC of the heating portion, which is a discharge control portion, is not adversely influenced, wherein stability of the discharge control can be improved. Also, since no electric leakage occurs, the voltage applied onto the discharge electrode is not lowered, wherein stability and efficiency of discharge are excellent.

A discharge control unit according to a twelfth aspect of the invention has a construction, in addition to any one of the first aspect through the eleventh aspect, in that the discharge control unit includes an induction electrode formed so as to be spaced from said discharge electrodes and to be insulated from the discharge electrodes.

With such a construction, the following action is included in addition to the actions of any one of the first aspect through the eleventh aspect.

(1) Since the induction electrode is formed so as to be spaced from the discharge electrodes and to be insulated therefrom, discharge can be induced from the discharge electrodes to the induction electrode, wherein it is possible to securely generate discharge.

Herein, where the induction electrode is spaced (offset) from the end part (edge) of the discharge electrode at the heat-generating body side in the horizontal direction and is formed on the heat generation portion insulating film, it is possible to securely insulate the induction electrode by covering the induction electrode with the induction electrode insulating film, wherein it is possible to prevent short-circuiting from occurring. At this time, the discharge electrode may be formed on the heat generation portion insulating film or may be formed on the induction electrode insulating film covered on the induction electrode.

Also, the induction electrode can be formed on the upper part of the discharge electrode via the induction electrode insulating film.

Although discharge is generated so as to be pulled by the induction electrode by grounding the induction electrode, ions and ultraviolet rays are projected toward an objective such as an image carrier as in a case where no induction electrode is provided.

Glass, ceramic, mica, synthetic resin, etc., may be preferably employed as the material of the induction electrode insulating film as in the above-described heat generation portion insulating film. Also, the thickness and forming method thereof, which are similar to those of the heat generation portion insulating film, may be preferably employed.

Where the discharge electrode is formed like comb teeth that are provided with individual discharge electrode portions, the induction electrode may be formed to be band-like with predetermined spacing provided from the tip end of the individual discharge electrode portions, and may be formed so as to enter between the individual discharge electrode portions.

A method for controlling discharge of a discharge control unit according to a thirteenth aspect of the invention is a method for controlling discharge of the discharge control unit according to any one of the first aspect through the twelfth aspect, wherein the same method includes a construction to carry out multi-divided discharge control by dividing heating of said discharge electrode by said heating portion into a plurality of times and repeating the same.

With such a construction, the following actions are included.

(1) By dividing the heating of the discharge electrode by the heating portion into a plurality of times by the multi-divided discharge control and repeating the same, it is possible to increase the number of times of rises in which the discharge amount is increased, and it is possible to increase the amount of projection of electrons, ions and ultraviolet rays as the entirety.

(2) By controlling the number of partitions of heating when carrying the multi-divided discharge control, it is possible to control the amount of projection of electrons, ions and ultraviolet rays, wherein it is possible to carry out area gradation and concentration gradation on an image carrier to which ions are projected, in an image forming apparatus of an electrostatic latent image forming system.

(3) Since, by carrying out the multi-divided discharge control and increasing the number of times of discharge, the amount of projection of electrons, ions, and ultraviolet rays is increased, it is possible to set the application voltage per time to a lower level and to shorten the discharge time, wherein a longer service life of the discharge electrodes can be brought about.

Herein, the multi-divided discharge control is carried out by repeating ON and OFF of electric current to the heat-generating body of the heating portion in a short time. By controlling the turning-on time of electric current to the heat-generating body per time and the number of times of repetition per time, it is possible to control the amount of projection of electrons, ions, and ultraviolet rays. In particular, where the discharge control unit is applied to an image forming apparatus of an ion projection system, it is possible to carry out area gradation and concentration gradation on an image carrier to which ions are projected.

A fourteenth aspect of the invention is a method for controlling discharge of the discharge control unit according to any one of the first aspect through the twelfth aspect, wherein the same method includes a construction to be provided with a step of preheating at least said discharge electrode.

With such a construction, the following actions are included.

(1) By preheating at least the discharge electrode in the step of preheating a discharge electrode, quick response to ON and OFF of electric current to the heat-generating body can be secured without being influenced by the ambient temperature, a stabilized motion can be brought about immediately after start of the discharge control unit. In particular, stabilized printing quality can be obtained at the beginning of printing in an image forming apparatus, wherein excellent reliability is secured.

(2) Since moisture adhered to the discharge electrode and its periphery can be extracted by the step of preheating the discharge electrode, excellent stability in discharge can be secured.

Herein, it is preferable that preheating is carried out in the step of preheating the discharge electrode so that the temperature of the entire discharge control unit becomes 40° C. through 60° C. As the preheating temperature becomes lower than 40° C., the preheating effect become insufficient, and simultaneously there is a tendency that it becomes difficult to control the temperature so as to be fixed. As the temperature becomes higher than 60° C., it takes much time to project heat from the discharge electrode, and responsiveness to turning-off of an electric current to the heat-generating body is apt to be worsened. Further, the temperature in the interior of the unit becomes remarkably high to adversely influence the driver IC, etc. Either case is not preferable. In particular, where the humidity is high, there is a tendency that the resistance of the discharge electrode is increased due to moisture in the peripheries and it becomes difficult for the discharge to be generated. Therefore, it is preferable that the entirety of the discharge control unit is preheated to a predetermined temperature level.

Also, it is preferable that the step of preheating the discharge electrode is carried out in a state where application of voltage to the discharge electrode is stopped, wherein there is no case where discharge is erroneously generated during preheating, and excellent reliability is secured. Further, preheating may be carried out directly by the heat-generating body of the heating portion, and heating means such as a heater may be separately provided.

In addition, the multi-divided discharge control and the step of preheating the discharge electrode may be used independently, respectively, or may be used in combination.

A method for producing a discharge control unit according to a fifteenth aspect of the invention is a method for producing the discharge control unit according to the seventh aspect, wherein a step of forming a discharge electrode corresponding to the heat-generating body includes a step of forming a conductive material layer on the surface of at least said common electrode portion of said discharge electrodes.

With such a construction, the following action is included.

(1) Since the step of forming discharge electrodes includes the step of forming a conductive material layer, it is possible to easily form a conductive material layer on the surface of at least the common electrode portion of the discharge electrodes, wherein it is possible to further reduce the resistance value of the common electrode portion.

Herein, the step of forming a conductive material layer is carried out by screen-printing, plating, etc. Where a sufficient thickness is not obtained by a single time of screen-printing, it is possible to obtain a sufficient thickness by carrying out the screen-printing a plurality of times, wherein it is possible to securely reduce the resistance value of the common electrode portion and the auxiliary common electrode portion.

Also, a method for producing a discharge control unit according to any one of the first aspect through the twelfth aspect of the invention includes: a step of forming a heat generation portion insulating film that covers at least an heat-generating body and insulates the heat-generating body; and a step of forming a discharge electrode on the heat generation portion insulating film corresponding to the heat-generating body. Thereby, it is possible to easily produce a discharge control unit only by adding the step of forming a heat generation portion insulating film which is an insulative body, and the step of forming a discharge electrode on the heat generation portion insulating film to the production process of the existing heating portion such as a thermal print head. In addition, by covering at least the heat-generating body with the heat generation portion insulating film in the step of forming a heat generation portion insulating film, it is possible to securely insulate the portion between the discharge electrode and the heat-generating body of the heating portion.

Screen-printing is preferably applied to the step of forming a heat generation portion insulating film. If formation of the heat generation portion insulating film is carried out a plurality of times, unevenness in the coating can be removed, wherein the heating portion can be securely insulated without any clearance, and excellent reliability is secured.

Also, it is preferable that the step of forming a discharge electrode is carried out by pattern formation of evaporating and spattering aluminum or pattern formation of etching a gold film. Where the discharge electrode is provided with a plurality of individual discharge electrode portions and where the individual discharge electrode portions are provided with split electrodes further divided into a plurality, it is possible to simultaneously form these in a single process, and excellent productivity can be secured.

A method for producing a discharge control unit according to a sixteenth aspect of the invention has a construction, in addition to the method for producing a discharge control unit according to the eighth aspect, in that the step of forming discharge electrodes on the heat generation portion insulating film corresponding to the heat-generating bodies includes a step of forming a conductive material layer on the surface of at least the auxiliary common electrode portion of the discharge electrodes.

With such a construction, the following action is included.

(1) Since the step of forming discharge electrodes includes the step of forming a conductive material layer, it is possible to easily form a conductive material layer on the surface of at least the auxiliary common electrode portion of the discharge electrodes, and it is possible to further reduce the resistance value of the auxiliary common electrode portion.

Herein, the step of forming a conductive material layer is carried out by screen-printing or plating. Where a sufficient thickness is not obtained by screen-printing of one time, it is possible to obtain a sufficient thickness by carrying out the screen-printing several times, wherein the resistance value of the auxiliary common electrode portion can be securely reduced.

A seventeenth aspect of the invention is a method for producing the discharge control unit according to the ninth aspect of the invention, wherein the step of forming a discharge electrode includes a step of forming said electrode protection thin film layer on the surface of said discharge electrode.

With such a construction, the following action is included.

(1) Since the step of forming a discharge electrode includes a step of forming an electrode protection thin film layer, an electrode protection thin film layer can be formed on the surface of a discharge electrode, wherein it is possible to prevent the surface of the discharge electrode from being worn due to impact when ions are generated in line with discharge, and the service life of the discharge electrode can be lengthened.

An eighteenth aspect of the invention is a method for producing the discharge control unit according to the tenth aspect of the invention, wherein the step of forming a discharge electrode includes a step of forming said coating film covered on said discharge electrode other than said discharge portion.

With such a construction, the following action is included.

(1) Since the step of forming a discharge electrode includes a step of forming a coating film, it is possible to lay out a coating film on the discharge electrode other than the discharge portion, and it is possible to prevent discharge from being generated from unnecessary points other than the discharge portion which is the point where discharge is to be generated.

(2) By forming a coating film on the discharge electrode other than the discharge portion in the step of forming a coating film, a stage difference can be formed between the surface of the discharge portion of the discharge electrode and the surface of the coating film, wherein it is possible to keep constant the stage difference between the discharge electrode and an image carrier disposed opposite thereto, and the image carrier can be prevented from being brought into contact with the discharge portion. Accordingly, discharge from the discharge portion can be stabilized.

Herein, screen-printing, evaporation or spattering may be preferably employed in the step of forming a coating film. By forming a pattern so that the discharge portion of the discharge electrode is opened, it is possible to easily and securely coat the discharge electrode other than the discharge portion.

Further, where recesses and projections are formed on the surface of the coating film, the surface distance of the coating film can be extended to increase the surface resistance, wherein it is possible to simply prevent electric leakage from occurring from the discharge portion of the discharge electrode.

Still further, since the recesses and projections of the coating film can be easily formed by screen-printing, etc., presence or absence of the recesses and projections does not make cumbersome the step of forming a coating film, wherein excellent mass productivity can be secured.

A nineteenth aspect of the invention is a method for producing the discharge control unit according to the twelfth aspect of the invention, wherein the same method is configured so as to be provided with a step of forming an induction electrode on the upper surface of said heat generation portion insulating film, being spaced from the end portion of said heat-generating body side of said discharge electrode in the horizontal direction, and a step of forming an induction electrode insulating film, which covers said induction electrode, on the upper surface of said heat generation portion insulating film.

With such a construction, the following actions are included.

(1) In the step of forming an induction electrode, it is possible to form an induction electrode for inducing discharge from the discharge electrode on the heat generation portion insulating film, being spaced from the end portion at the heat-generating body side of the discharge electrode in the horizontal direction.

(2) In the step of forming an induction electrode insulating film, it is possible to form an induction electrode insulating film, which covers and insulates the induction electrode, between the discharge electrode and the heat generation portion insulating film.

Herein, in the step of forming an induction electrode, it is possible to form a band-shaped induction electrode by removing excess points of a gold film by etching after the gold film is formed on the heat generation portion insulating film.

In addition, in the step of forming an induction electrode insulating film, an induction electrode insulating film is formed on the induction electrode by using screen-printing, etc.

Where the induction electrode and the induction electrode insulating film are provided, it is possible to form a discharge electrode on the induction electrode insulating film by the step of forming a discharge electrode as described above.

In addition, the step of forming a conductive material layer, step of forming an electrode protection thin film layer, step of forming a coating film, step of forming an induction electrode, and step of forming an induction electrode insulating film may be carried out independently, respectively, or may be carried out with any two or more steps combined.

As described above, with the discharge control unit, method for controlling discharge of the same, and method for producing the same according to the invention, the following advantageous effects can be brought about.

According to the first aspect of the invention, the following effects can be brought about.

(1) Since the heating portion is provided with a driver IC electrically connected to one or a plurality of heat-generating bodies and selectively causes an electric current to flow to any optional point of one heat-generating body or to a plurality of heat-generating bodies and causes the same to generate heat, the first aspect of the invention can provide a discharge control unit capable of selectively heating an optional position (discharge portion) of a discharge electrode, disposed so as to correspond to the heat-generating body, to which voltage is applied, and capable of generating discharge, which is controllable by a low voltage, small-sized, and excellent in mass productivity.

(2) The first aspect of the invention can provide a discharge control unit having excellent versatility, which is utilized for a plasma display panel (PDP) for causing a fluorescent substance to emit light by projecting ultraviolet rays, which are generated in an atmosphere of an inactive gas such as Xenon gas, neon gas, etc., that permit generation of only a slight amount of ions, to the fluorescent substance, a field emission display (FED) for causing a fluorescent substance to emit light by bringing thermoelectrons, which are emitted like an electron gun in a vacuum state where it is impossible to generate ions, into collision with the fluorescent substance, and a vacuum fluorescent display (VFD) for causing a fluorescent substance to emit light by bringing thermoelectrons into collision with the fluorescent substance while controlling (diffusing and selecting) and accelerating the thermoelectrons in addition to an image forming apparatus capable of forming an electrostatic latent image by ions projected in an atmosphere where ions can be generated.

(3) The first aspect of the invention can provide a discharge control unit capable of generating discharge by selectively heating an optional position of the discharge electrode by means of an heat-generating body without any minute positioning between the heat-generating body and the discharge electrode, which is excellent in mass productivity of discharge electrodes.

(4) The first aspect of the invention can provide a discharge control unit capable of controlling the discharge time at the discharge portion of a discharge electrode only by controlling the heating time of the discharge electrode by means of an heat-generating body of the heating portion and also capable of controlling the amount of generation of ions from the discharge portions, maneuverability of which is excellent.

(5) The first aspect of the invention can provide a high-quality discharge control unit capable of controlling the amount of generation of ions only by controlling the heating time to a discharge electrode by the heating portion and capable of easily carrying out area gradation in an image forming apparatus of an electrostatic latent image forming system, which is high in quality and excellent in practical use.

According to the second aspect of the invention, the following effect can be brought about.

(1) The second aspect of the invention can provide a discharge control unit capable of lengthening the peripheral length of the edge peripheries of respective individual discharge electrode portions opposed to an heat-generating body by dividing a part of the discharge electrode into a plurality of individual discharge electrode portions, in which discharge from the individual discharge electrode portions is easily generated, and excellent discharge stability is secured, and capable of increasing the amount of projected ions and ultraviolet rays by increasing the amount of discharge, in which excellent energy saving performance and efficiency can be secured.

(2) The second aspect of the invention can provide a discharge control unit capable of preventing heat from being confined in the individual discharge electrode portions by forming the width of the common electrode portion wider than the width of the individual discharge electrode portions and increasing the heat radiation amount from the common electrode portion, therefore capable of changing over presence or absence of discharge in a short time by shortening the discharge time interval, and capable of making the printing speed higher, which is excellent in responsiveness.

(3) The second aspect of the invention can provide a discharge control unit capable of reducing the potential difference and unevenness in the discharge amounts, which occur between the respective individual discharge electrodes connected to each other by the common electrode portion, by forming the width of the common electrode portion wider and widening the area and lowering the resistance value of the common electrode portion.

According to the third aspect of the invention, the following effect can be brought about in addition to the effect of the second aspect.

(1) The third aspect of the invention can provide a discharge control unit capable of lengthening the outer circumferential length of a discharge electrode and increasing the amount of discharge from the edge peripheries of the discharge electrode by dividing individual discharge electrode portions of the discharge electrode and forming a plurality of split electrodes, and capable of increasing the amount of projection of electrons, ions, and ultraviolet rays, by which excellent efficiency and energy saving performance can be secured.

According to the fourth aspect of the invention, the following effect can be brought about in addition to the effects of the second aspect or the third aspect.

(1) The fourth aspect of the invention can provide a discharge control unit capable of disposing a plurality of discharge portions at high density by disposing a plurality of individual discharge electrode portions in chessboard patterns, and capable of simply improving the resolution and recording speed of an image forming apparatus, which is high in quality and excellent in productivity.

According to the fifth aspect of the invention, the following effect can be brought about in addition to the effects of any one of the first aspect through the third aspect.

(1) The fifth aspect of the invention can provide a high quality discharge control unit capable of disposing a plurality of discharge portions at high density by disposing a plurality of heat-generating bodies in chessboard patterns and simply improving the resolution and printing speed of an image forming apparatus, which ensures excellent productivity.

According to the sixth aspect of the invention, the following effect can be brought about in addition to the effects of any one of the second aspect through the fifth aspect.

(1) The seventh aspect of the invention can provide a discharge control unit capable of further improving the cooling effect of discharge electrodes by enlargement of the heat radiation area along with the common electrode by the discharge electrode having an auxiliary common electrode portion for connecting the other end portions of a plurality of individual discharge electrode portions, capable of securing excellent responsiveness to turning-off of heating, and capable of reducing unevenness in the discharge amount by lowering the resistance value, which has excellent discharge stability.

According to the seventh aspect of the invention, the following effect can be brought about in addition to the effects of any one of the first aspect through the sixth aspect.

(1) The eighth aspect of the invention can provide a discharge control unit capable of further reducing the resistance value of the common electrode portion by forming a conductive material layer on the surface of at least the common electrode portion of the discharge electrodes and capable of securely reducing the potential difference occurring between the respective discharge portions, the discharge stability of which is excellent.

According to the eighth aspect of the invention, the following effect can be brought about in addition to the effects of the sixth aspect.

(1) The resistance value of the auxiliary common electrode portion can be further reduced, and the potential difference occurred between the respective individual discharge electrode portions can be securely reduced.

According to the ninth aspect of the invention, the following effect can be brought about in addition to the effects of any one of the first aspect through the eighth aspect.

(1) The ninth aspect of the invention can provide a discharge control unit capable of preventing the surface of the discharge electrode from being worn due to impact when ions are generated, by the electrode protection thin film layer formed on the surface of the discharge electrode, the discharge electrodes of which have an excellent long service life.

According to the tenth aspect of the invention, the following effects can be brought about in addition to the effects of any one of the first aspect through the ninth aspect.

(1) The tenth aspect of the invention can provide a discharge control unit capable of preventing discharge from occurring at excess points other than the discharge portion of the discharge electrode by means of a coating film covered on the discharge electrode other than the discharge portion, and capable of concentrating electrons, ions and ultraviolet rays to one point and projecting the same thereto, the efficiency of which is excellent.

(2) The tenth aspect of the invention can provide a discharge control unit capable of keeping constant the stage difference between the discharge electrode and the image carrier, etc., disposed opposite thereto by forming a coating film excepting the discharge portion of the discharge electrode and forming the stage difference between the surface of the discharge portion and the surface of the coating film and capable of preventing the image carrier from being brought into contact with the discharge portion, which secures excellent stability in discharge from the discharge electrode.

According to the eleventh aspect of the invention, the following effect can be brought about in addition to the effects of the tenth aspect.

(1) The eleventh aspect of the invention can provide a discharge control unit capable of preventing electric leakage from occurring from the points, where discharge is generated, of the individual discharge electrode portions to the peripheries by forming recesses and projections on the surface of the coating film, lengthening the surface distance of the coating film and increasing the surface resistance, which secures excellent stability.

According to the twelfth aspect of the invention, the following effect can be brought about in addition to the effects of any one of the first aspect through the eleventh aspect.

(1) The eleventh aspect of the invention can provide a discharge control unit capable of inducing discharge from the discharge electrode by means of the induction electrode formed to be spaced from the discharge electrode and capable of securing generating discharge, which has excellent stability in discharge control.

According to the thirteenth aspect of the invention, the following effects can be brought about.

(1) The thirteenth aspect of the invention can provide a method for controlling discharge of a discharge control unit, which is capable of increasing the number of times of rises, in which the discharge amount is increased, by carrying out multi-divided discharge control for dividing the heating of the discharge electrode by the heating portion into a plurality of times and repeating the same, and capable of increasing the amount of projection of electrons, ions, and ultraviolet rays as a whole, and which brings about a discharge control unit having excellent energy saving performance and excellent efficiency.

(2) The thirteenth aspect of the invention can provide a method for controlling discharge of a discharge control unit, which is capable of controlling the amount of projection of electrons, ions, and ultraviolet rays by controlling the number of partitions of heating in the multi-divided discharge control and capable of carrying out area gradation and concentration gradation on an image carrier, to which ions are projected, in an image forming apparatus of an electrostatic latent image forming system, and which brings about a discharge control unit having excellent practical use.

(3) The thirteenth aspect of the invention can provide a method for controlling discharge of a discharge control unit, which is capable of increasing the amount of projection of electrons, ions, and ultraviolet rays by increasing the number of partitions in the multi-divided discharge control, and capable of setting the application voltage per time to a low level and shortening the discharge time, and which brings about a discharge control unit having an excellent long service life of the discharge electrodes.

According to the fourteenth aspect of the invention, the following effects can be brought about.

(1) The fourteenth aspect of the invention can provide a method for controlling discharge of a discharge control unit, which is capable of, in the step of preheating discharge electrodes, making quick response to presence or absence of an electric current to heat-generating bodies by preheating at least the discharge electrodes without being influenced by the ambient temperature, capable of obtaining stabilized actions immediately after start of the discharge control unit, and capable of obtaining stabilized printing quality from the beginning of printing commencement particularly in an image forming apparatus, and which brings about a discharge control unit having excellent reliability.

(2) The fourteenth aspect of the invention can provide a method for controlling discharge of a discharge control unit, which is capable of extracting moisture adhered to the discharge electrodes and the peripheries thereof by the step of preheating discharge electrodes, and which brings about a discharge control unit having excellent discharge stability.

According to the fifteenth aspect of the invention, the following effect can be brought about.

(1) The fifteenth aspect of the invention can provide a method for producing a discharge control unit, which is capable of forming a conductive material layer in the step of forming a conductive material layer, by which the resistance value of the common electrode portion of the discharge electrode and the auxiliary common electrode portion thereof can be further reduced, and the potential difference occurring between the respective individual discharge electrode portions can be securely lowered, and which brings about a discharge control unit having excellent discharge stability.

According to the sixteenth aspect of the invention, the following effect can be brought about.

(1) The sixteenth aspect of the invention can provide a method for producing a discharge control unit, having excellent stability in discharge, which is capable of further reducing the resistance value of the auxiliary common electrode portion of the discharge electrode and forming a conductive material layer that can securely reduce the potential difference occurred between the respective individual discharge electrode portions, in the step of forming a conductive material layer.

According to the seventeenth aspect of the invention, the following effect can be brought about.

(1) The seventeenth aspect of the invention can provide a method for producing a discharge control unit, which is capable of, in the step of forming an electrode protection thin film layer, forming an electrode protection thin film layer that prevents the surface of the discharge electrodes from being worn due to impact when ions are generated, and which secures an excellent long service life of the discharge electrodes.

According to the eighteenth aspect of the invention, the following effects can be brought about.

(1) The eighteenth aspect of the invention can provide a method for producing a discharge control unit, which is capable of, in the step of forming a coating film, forming a coating film that can prevent discharge from being generated from excess points other than the discharge portion of the discharge electrode, and which brings about a discharge control unit having excellent reliability.

(2) The eighteenth aspect of the invention can provide a method for producing a discharge control unit, which is capable of, in the step of forming a coating film, covering a coating film that forms a stage difference between the surface of the discharge portion of the discharge electrode and the surface of the coating film, and stabilizing discharge from the discharge portion by preventing the discharge portion and the image carrier from contracting each other, and which brings about a discharge control unit having high quality and excellent reliability.

According to the nineteenth aspect of the invention, the following effects can be brought about.

(1) The nineteenth aspect of the invention can provide a method for producing a discharge control unit, which is capable of forming an induction electrode, which is spaced from the end portion at the heat-generating body side of the discharge electrode in the horizontal direction, and induces discharge from the discharge electrode, on the heat generation portion insulating film in the step of forming an induction electrode, and which brings about a discharge control unit securing reliable discharge.

(2) The nineteenth aspect of the invention can provide a method for producing a discharge control unit, which is capable of forming an induction electrode insulating film, which covers and insulates an induction electrode insulating film between the discharge electrode and the heat generation portion insulating film, in the step of forming an induction electrode insulating film, and which brings about a discharge control unit having excellent reliability.

EMBODIMENT 1

A description is given below of a discharge control unit, a method for controlling discharge of the same, and a method for producing the same according to Embodiment 1 of the invention with reference to the accompanying drawings.

Figure 1:
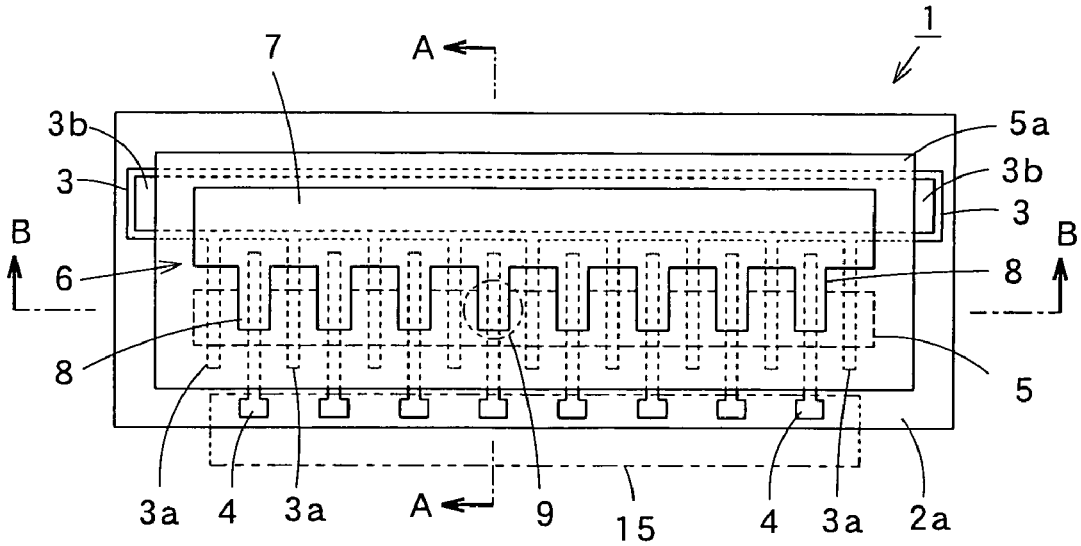
FIG. 1 is a schematic plan view showing a discharge control unit according to Embodiment 1 of the invention.
Figure 2A:
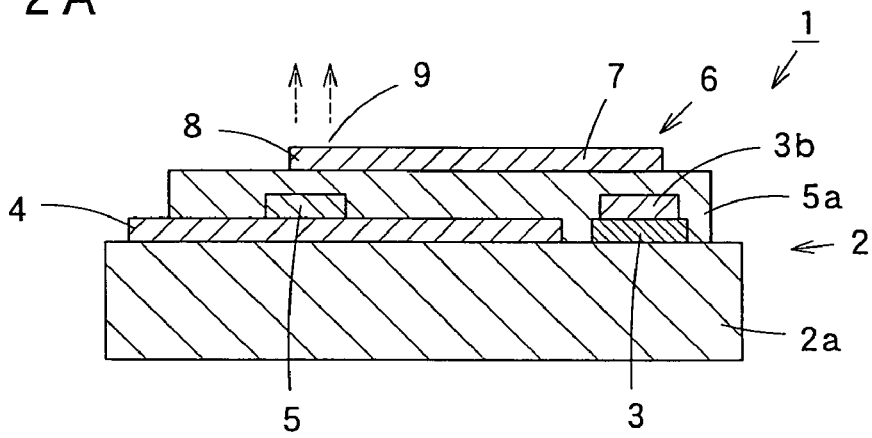
FIG. 2A is a sectional view taken along the line A-A in FIG. 1.
Figure 2B:
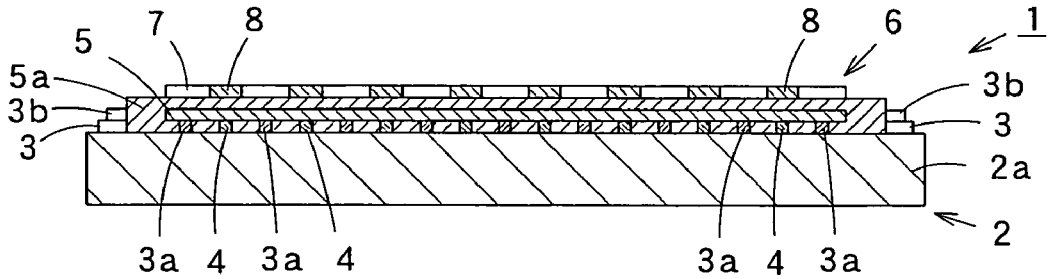
FIG. 2B is a sectional view taken along the line B-B in FIG. 1.
Figure 3:
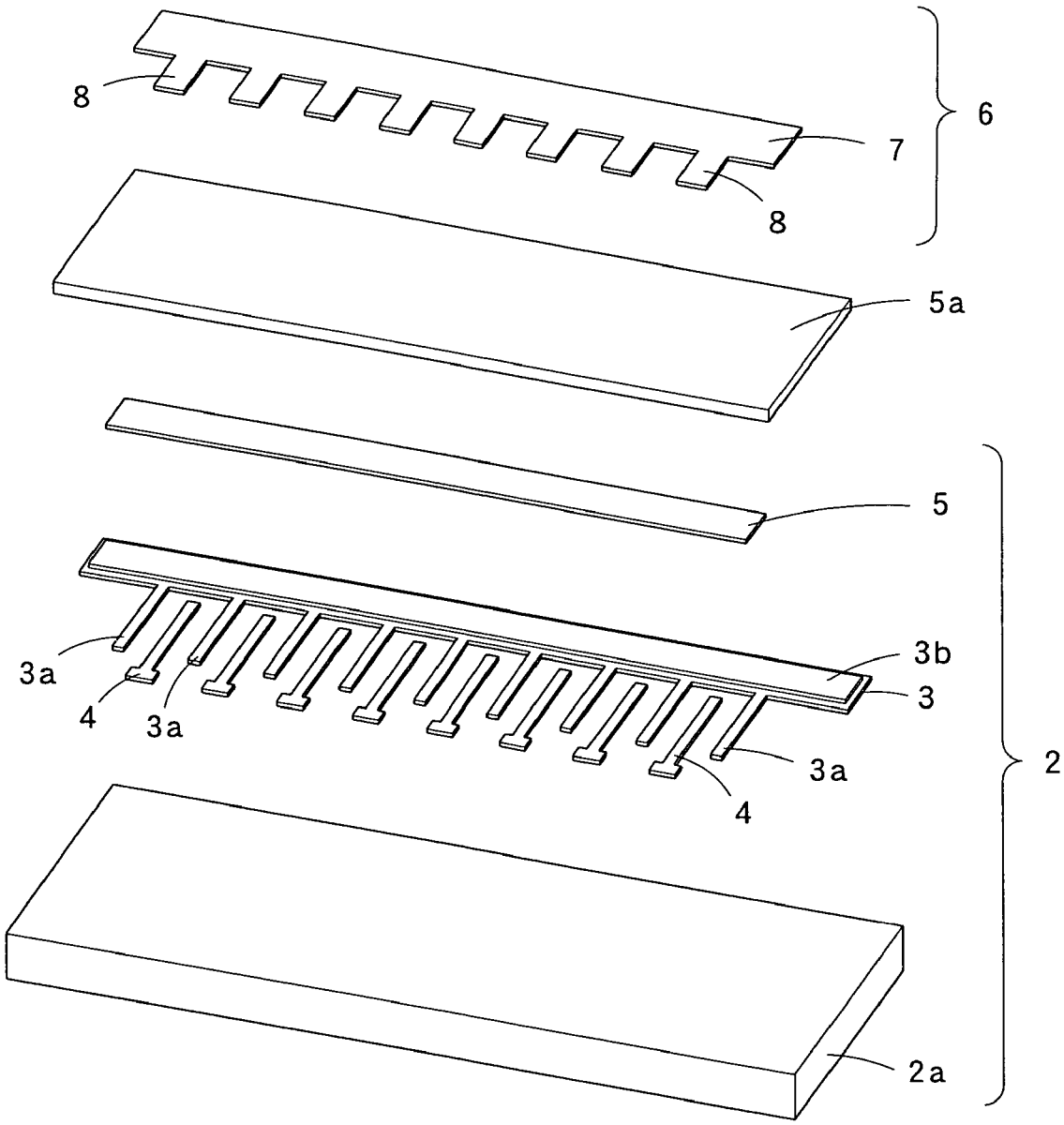
FIG. 3 is a disassembled schematic perspective view showing a discharge control unit according to Embodiment 1 of the invention.

FIG. 1A is a schematic plan view showing a discharge control unit according to Embodiment 1 of the invention, FIG. 2A is a sectional view taken along the line A-A in FIG. 1, and FIG. 2B is a sectional view taken along the line B-B in FIG. 1, and FIG. 3 is a disassembled schematic perspective view showing a discharge control unit according to Embodiment 1 of the invention.

In FIG. 1 through FIG. 3, reference numeral 1 denotes a discharge control unit according to Embodiment 1 of the invention; 2 denotes a heating portion of the discharge control unit 1, 2*a* denotes a substrate of the heating portion 2, 3 denotes a common conductor pattern of the heating portion 2, which is connected to a plurality of comb teeth pattern portions 3*a* and is formed on the upper surface of the substrate 2*a*, and 3*b* denotes a common electrode for heat generation of the heating portion 2, which is disposed on the upper surface of the common conductor pattern 3. Reference numeral 4 denotes an individual electrode of the heating portion 2, which is formed on the upper surface of the substrate 2*a*, being alternated with the comb teeth pattern portion 3*a*, 5 denotes an heat-generating body electrically connected to and disposed on the comb teeth pattern portions 3*a* and the individual electrodes 4, 5*a* denotes a heat generation portion insulating film covered on the upper surface of the substrate 2*a*, excepting the end portions of the common electrode 3*b* for heat generation and the individual electrodes 4, 6 denotes a discharge electrode formed to be comb teeth-shaped on the upper surface of the heat generation portion insulating film 5*a*, 7 denotes a common electrode portion of the discharge electrode 6, and 8 denotes a plurality of individual discharge electrode portions, one-sided ends of which are connected by the common electrode portion 7, formed opposite the heat-generating body 5 corresponding to the position of respective individual electrodes 4. Reference numeral 9 denotes a discharge portion of the individual discharge electrode portion 8, which generates discharge by being heated by the heat-generating body 5, and 15 denotes a driver IC for causing the heat-generating body 5 to generate heat by selectively flowing an electric current to an optional position of the heat-generating body 5 connected to the individual electrode 4 and for controlling selective discharge from the discharge portion 9 of the individual discharge electrode portion 8.

Although it is considered that there are various combinations with respect to volumes of alternate current voltage and direct current voltage applied to the discharge electrode 6, in the present embodiment, as one example, −700V voltage is superposed to AC550Vpp (Triangular wave 1 kHz) via a DC bias and applied. Also, AC550Vpp is superposed in order to obtain stability of discharge.

No discharge occurs from the discharge portion 9 of the individual discharge electrode portion 8 by applying only voltage to the discharge electrode 6. Thermoelectrons are emitted from the discharge portion 9 of the individual discharge electrode portion 8 selectively heated by controlling the heating portion 2 and further selectively heating the individual discharge electrode portion 8 by the heat-generating body 5 (to 200 through 300° C.), wherein discharge occurs in the direction of the arrow in FIG. 2. That is, the heating portion 2 is a trigger to cause the discharge control unit 1 to generate discharge, and it can be said that the discharge control unit 1 according to the invention is a discharge control unit of a so-called heat-discharge system.

As discharge occurs, ions are generated in an atmosphere where ions can be generated, and ions are projected in the direction of the arrow in FIG. 2. The discharge control unit 1 is used in an atmosphere where ions can be generated (this means that air is available) where it is necessary to form an electrostatic latent image as in an image forming apparatus, etc. However, where only the discharge phenomenon is required with any electrostatic latent image not required, the discharge control unit 1 may be used in an atmosphere that permits to generate only a slight amount of ions or in a vacuum state where no ions can be generated. For example, as in respective cells of a plasma display panel (PDP), once discharge occurs, a plasma state is brought about in an atmosphere of an inactive gas such as Xenon gas and neon gas, which permits to generate only a slight amount of ions, and ultraviolet rays are projected, wherein the ultraviolet rays are converted to visible light beams by fluorescent substances such as R, G and B, which are adhered to the cells. In a vacuum state where no ions can be generated as in the respective cells of a field emission display (FED), the individual discharge electrode portion 8 emits thermoelectrons like an electron gun (while accompanying discharge), wherein emitted thermoelectrons are accelerated and brought into collision with fluorescent substances such as R, G, and B adhered to the cells, emit light and are made into visible light beams. In a vacuum fluorescent display (VFD), thermoelectrons emitted in a vacuum vessel are controlled (diffused, selected), accelerated, and further brought into collision with a fluorescent substance on which a display pattern is drawn, thereby emitting light.

The heating portion 2 for selectively heating a plurality of individual discharge electrode portions 8 by means of the heat-generating body 5 is an indirect switch for the discharge electrode 6 and takes a role as a discharge control portion. It is sufficient that voltage applied to the heating portion 2, in other words, voltage for causing the heat-generating body 5 to generate heat is a low voltage of, for example, 24V, and it is sufficient that the driver IC 15 used for a switch portion for selectively causing the portion corresponding to the discharge portion 9 of the individual discharge electrode portion 8 of the heat-generating body 5 to generate heat is such a type as it copes with low dielectric strength of, for example, 5V drive.

Therefore, an inexpensive versatile driver IC coping with low dielectric strength may be used as the driver IC 15 used for the heating portion 2, wherein it is possible to aim at reducing the costs of the heating portion 2. In addition, the driver IC 15 coping with a low dielectric strength permits to narrow respective disposed intervals, and at the same time, permits to narrow the intervals of lead patterns extending from the driver IC 15, wherein it is possible to aim at downsizing the entirety of the heating portion 2.

A description is given of a method for producing the discharge control unit according to Embodiment 1, which is constructed as described above.

Figure 4:
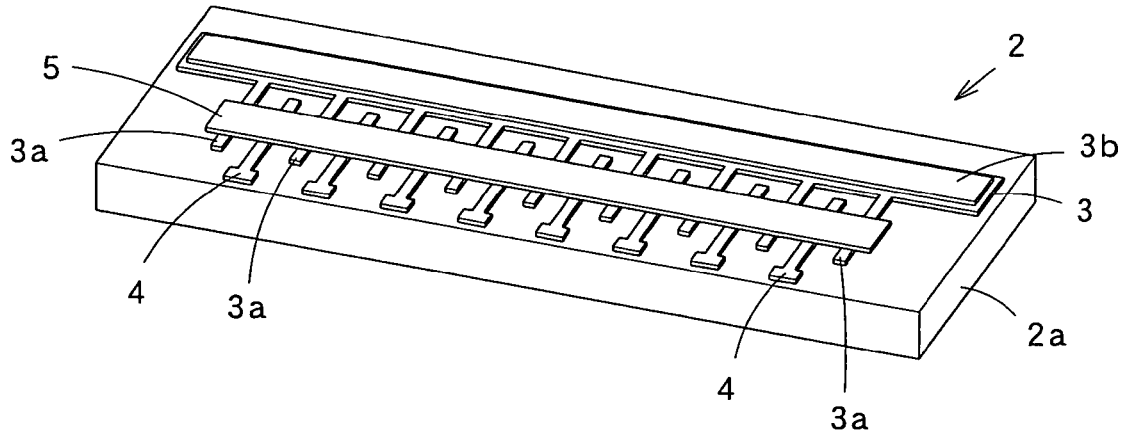
FIG. 4 is a perspective view showing a step of forming a heating portion of a method for producing the discharge control unit according to Embodiment 1 of the invention.
Figure 5:
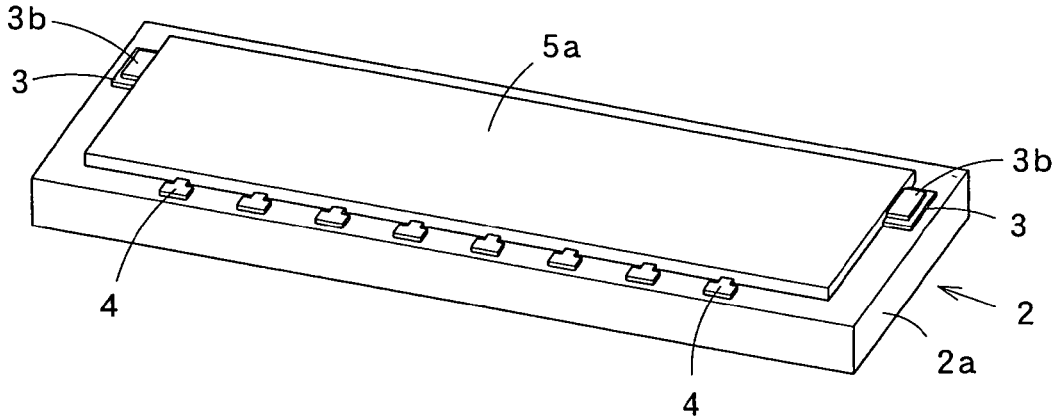
FIG. 5 is a perspective view showing a step of forming a heat generation portion insulating film of the method for producing the discharge control unit according to Embodiment 1 of the invention.
Figure 6:
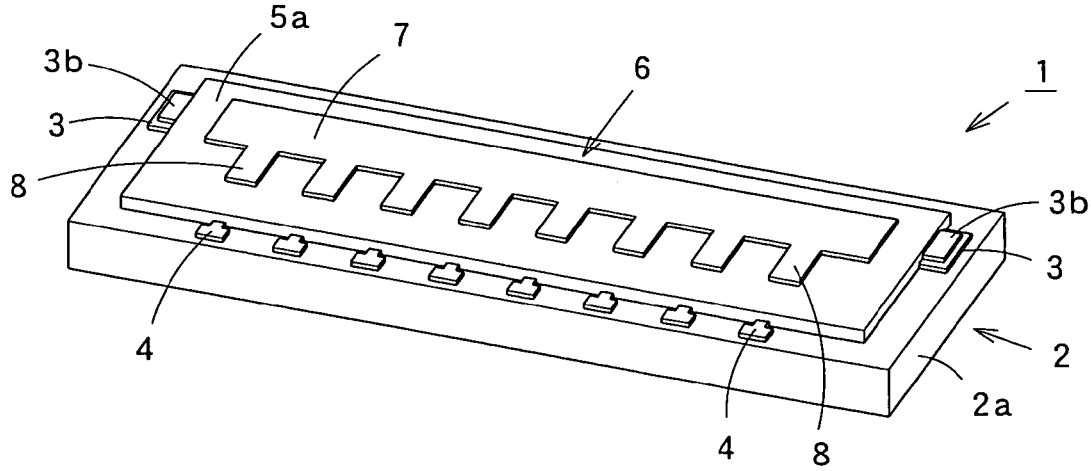
FIG. 6 is a perspective view showing a step of forming a discharge electrode of the method for producing the discharge control unit according to Embodiment 1 of the invention.

FIG. 4 is a perspective view showing a step of forming a heating portion of a method for producing the discharge control unit according to Embodiment 1 of the invention, FIG. 5 is a perspective view showing a step of forming a heat generation portion insulating film of the method for producing the discharge control unit according to Embodiment 1 of the invention, and FIG. 6 is a perspective view showing a step of forming a discharge electrode of the method for producing the discharge control unit according to Embodiment 1 of the invention.

First, a description is given of the step of forming the heating portion.

In FIG. 4, after a conductor such as gold paste, etc., is printed on the upper surface of the substrate 2*a* formed of ceramic, etc., to be long-plated, a plurality of comb teeth pattern portions 3*a* and individual electrodes 4, which are connected by the common conductor pattern 3, are formed by etching. After that, $TaSiO_2$ or $RuO_2$ is printed on the comb teeth pattern portions 3*a* and individual electrodes 4 to form a band-shaped heat-generating body 5. Also, silver paste is printed on the upper surface of the common conductor pattern 3 to form the common electrode 3*b* for heat generation.

A bonding pad is formed on the end portion of the individual electrode 4, whereby it becomes possible to easily carry out connection with the driver IC 15 by wire bonding.

In addition, the heating portion 2 of a construction that is similar to that of a thermal print head used for a prior art photosensitive type facsimile may be preferably employed. In this case, the production can follow a production step of the existing thermal print head, wherein it is possible to produce the discharge control unit 1 at low costs by using the existing production apparatuses.

Since the embodiment is constructed so that the heat-generating body 5 of the heating portion 2 is formed to be band-shaped, the comb teeth pattern portions 3*a* and the individual electrodes 4 are alternately disposed with each other, and an electric current is caused to flow between one individual electrode 4 at the middle and the comb teeth patterns portions 3*a* at both sides thereof, such a system is employed in which an optional point of the heat-generating body 5 corresponding to the position of the discharge portion 9 of the respective individual electrode portions 8 is selectively caused to generate heat, and the individual discharge electrode portions 8 are heated. However, any structure may be employed if the structure can selectively heat the discharge portion 9 of the respective individual discharge electrode portions 8.

Next, a description is given of the step of forming a heat generation portion insulating film.

In FIG. 5, an insulative body such as glass, ceramic, mica, synthetic resin, etc., is printed on the upper surface of the substrate 2*a*, excepting the respective end portions of the common electrode 3*b* for heat generation and the individual electrodes 4, thereby forming the heat generation portion insulating film 5*a*. The heat generation portion insulating film 5*a* may be any material as long as it can protect the heat-generating body 5, the common electrode 3*b* for heat generation and the individual discharge electrode 4 and insulates the same. However, it is preferable that the insulating film is a material which is capable of efficiently transmitting heat of the heat-generating body 5 to the individual discharge electrode portions 8 and has high conductivity, such as SiAl, $SiO_2$, SiC, polyamide, aramind, etc.

Although the optimal thickness of the heat generation portion insulating film 5*a* depends on the material, the thickness was formed to be 4 μm through 40 μm where the film was formed of glass, because it has been found that there is a tendency for the insulation property to be lowered as the thickness of the heat generation portion insulating film 5*a* becomes thinner than 4 μm, and there is a tendency for the energy saving performance to be lowered since, as the thickness thereof becomes thicker than 40 μm, it is necessary that the voltage applied to the discharge electrode 6 and the amount of heat generation of the heat-generating body 5 are increased. Where the thickness of the heat generation portion insulating film 5*a* is set to 4 μm through 40 μm, the insulation property and thermal conductivity are well balanced and satisfactory, wherein excellent discharge stability is secured.

Also, where printing of the heat generation portion insulating film 5*a* is divided into several times and carried out, it is possible to eliminate unevenness in the coating, and the heating portion 5 can be securely insulated without any clearance, wherein excellent reliability is secured.

Next, a description is given of the step of forming a discharge electrode.

In FIG. 6, a plurality of individual discharge electrode portions 8 opposed to the individual electrodes 4 of the heating portion 2 and the common electrode 7 for connecting the same are formed on the upper surface of the heat generation portion insulating film 5*a*. It is preferable that the common electrode 7 and the individual discharge electrode portions 8 are formed of a pattern formed by evaporation and spattering of aluminum or etching of gold film.

In addition, although the individual discharge electrode portions 8 are formed to be rectangular in the embodiment, the electrode portions 8 may be formed in a trapezoidal or semi-circular form, or may be shaped in a combination thereof. Further, since the discharge portions 9 of the individual discharge electrode portions 8 have a great amount of discharge from the edge peripheries thereof, a plurality of recesses and projections may be formed at the outer circumferential edges of the individual discharge electrode portions 8 so that the circumferential length of the edge peripheries can be lengthened. It is possible to increase the projected amount of ions and ultraviolet rays by increasing the amount of discharge from the discharge portions 9, wherein excellent energy saving performance and efficiency can be secured in the discharge control unit 1. In addition, since the application voltage applied to the individual discharge electrode portions 8 can be set to be lower, an excellent long service life of the individual discharge electrode portions 8 can be secured.

The step of forming a discharge electrode may be provided with a step of forming an electrode protection thin film layer by which an electrode protection thin film layer (not illustrated) is formed on the surface of the discharge electrode 6 by spattering and evaporation. Thereby, it is possible to prevent the surface of the discharge electrode 6 from being worn due to impact when ions are generated in line with discharge, wherein an excellent long service life of the discharge electrode 6 can be secured.

An inorganic material such as SiON, SiO2, MgO, etc., may be preferably employed as a material of the electrode protection thin film layer. This is because it is possible to prevent the discharge electrode 6 from deteriorating due to spatter and oxidization of the surface of the discharge electrode 6 due to generated ions, and simultaneously to prevent creeping discharge.

The electrode protection thin film layer was formed so that the thickness thereof was 2 μm through 5 μm. It has been found that, as the thickness of the electrode protection thin film layer becomes thinner than 2 μm, the surface of the discharge electrode cannot be securely covered, wherein pinholes are apt to occur, and there is a tendency that the reliability becomes deficient, and as the thickness thereof becomes thicker than 5 μm, it becomes hard for discharge to occur, wherein there is a tendency that mass productivity becomes deficient.

A description is given of a method for controlling discharge of a discharge control unit according to Embodiment 1 constructed as described above.

Figure 7:
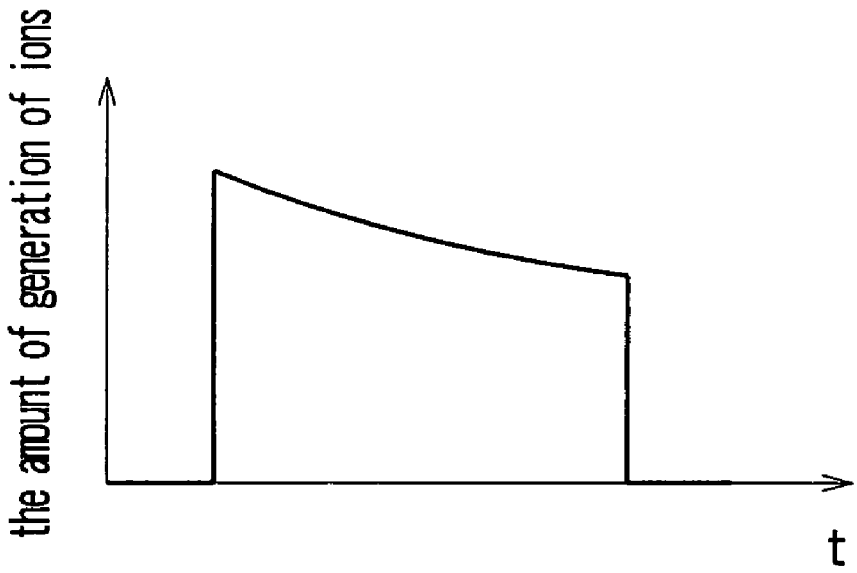
FIG. 7 is a view showing the amount of generation of ions in the discharge control unit according to Embodiment 1 of the invention.

FIG. 7 is a view showing the amount of generation of ions in the discharge control unit according to Embodiment 1 of the invention.

In FIG. 7, the abscissa indicates the elapse of time of heating by the heat-generating body 5 of the heating portion 2, and the ordinate indicates the amount of generation of ions from the discharge portion 9 heated by the heat-generating body 5.

When an electric current is caused to flow to the heat-generating body 5 for a fixed duration of time and the temperature of the discharge portion 9 of the individual discharge electrode portion 8 heated by the heat-generating body 5 that generates heat exceeds a fixed temperature, discharge occurs, and in the atmosphere, ions are generated as shown in FIG. 7. Therefore, by controlling the heating time of the individual discharge electrode portion 8 of the discharge electrode 6 by the heat-generating body 5 of the heating portion 2, it is possible to control the discharge time at the discharge portion 9 of the individual discharge electrode portion 8, wherein it is possible to control the amount of generation of ions from the discharge portion 9.

Further, as shown in FIG. 7, it is observed that the amount of generation of ions (that is, the discharge amount) is great at a rise of heating, and there is a tendency that the amount of generation of ions gradually decreases in line with elapse of time. Also, the temperature at which discharge is commenced from the discharge portion 9 fluctuates by voltage applied to the discharge electrode 6.

Where the discharge control unit 1 according to Embodiment 1 is used as a print head of an image forming apparatus of an electrostatic latent image forming system, it becomes possible to carry out area gradation on an image carrier to which ions are projected, only by controlling the heating time to the discharge electrode 6 by the heating portion 2, wherein the image quality can be improved.

Next, a description is given of another method for controlling discharge of a discharge control unit according to Embodiment 1.

Figure 8:
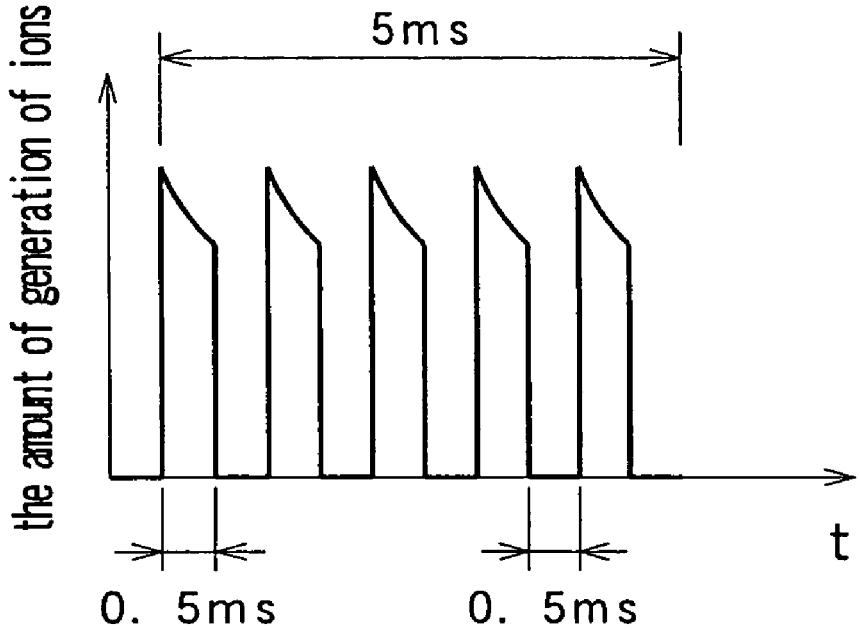
FIG. 8 is a view showing the amount of generation of ions when carrying out multi-divided discharge control of the discharge control unit according to Embodiment 1 of the invention.

FIG. 8 is a view showing the amount of generation of ions when carrying out multi-divided discharge control of the discharge control unit according to Embodiment 1 of the invention;

By carrying out multi-divided discharge control by which heating of the individual discharge electrode portion 8 by means of the heating portion 2 is divided into a plurality of times and repeated, it is possible to increase the number of rises in which the amount of generation of ions is increased, and it is possible to further increase the amount of generation of ions as a whole than in FIG. 7.

Since the amount of generation of ions can be controlled by controlling the number of partitions, it is possible to carry out area gradation and concentration gradation on an image carrier to which ions are projected, where the discharge control unit 1 according to Embodiment 1 is used as a print head of an image forming apparatus of an electrostatic latent image forming system.

Further, by increasing the number of partitions, it is possible to increase the amount of generation of ions, to set the application voltage per time to a lower level, and to shorten the discharge time, wherein it is possible to aim at lengthening the service life of the individual discharge electrode portions 8.

Although, in the embodiment, the turning-on time and turning-off time of heating are set to 0.5 ms, and the number of times of repetition of heating is set to 5, it is not necessary that the ON and OFF times are made equal to each other, and that the respective ON and OFF times are equal to each other. Also, the number of times of repetition of heating, duration of the ON and OFF times, and intensity of application voltage applied to the discharge electrode 6 may be adequately selected.

In addition, where the discharge control unit 1 is provided with the step of preheating at least the discharge electrode 6 (the individual discharge electrode portion 8), quick response to ON and OFF of an electric current to the heat-generating body 5 can be secured without being influenced by the ambient temperature, wherein it is possible to obtain a stabilized action immediately after the discharge control unit 1 is started. Also, moisture adhered to the discharge electrode 6 and the peripheries thereof can be extracted, and excellent discharge stability can be secured.

Although the optimal preheating temperature in the step of preheating a discharge electrode changes by the ambient temperature and the voltage applied to the discharge electrode 6, the preheating temperature was set in such a range that the temperature of the entire discharge control unit 1 became 40° C. through 60° C. This is because it has been found that, as the preheating temperature becomes lower than 40° C., the preheating effect becomes insufficient, and there is a tendency that it becomes difficult to manage the temperature at a fixed level, and as the preheating temperature becomes higher than 60° C., the time of heat radiation from the discharge electrode 6 is increased, the responsiveness to turning-off of an electric current to the heat-generating body 5 is lowered, and simultaneously the temperature in the interior of the unit becomes too high, wherein there is a tendency that adverse influence imparted on the driver IC 15 is brought about.

The step of preheating the discharge electrodes is carried out by heating the vicinity of the discharge portion 9 of the individual discharge electrode portion 8 by means of the heat-generating body 5 in a state where no voltage is applied to the discharge electrode 6. However, heating means such as a heater for preheating may be provided in order to heat the discharge electrode 6 and the vicinity thereof.

Since the discharge control unit according to Embodiment 1 is constructed as described above, the following actions are included.

(1) Since the heating portion 2 is provided with the heat-generating body 5 and the driver IC 15 which is electrically connected to the heat-generating body 5 and causes the heat-generating body 5 to generate heat by selectively flowing an electric current to an optional point of the heat-generating body 5, an optional individual discharge electrode portion 8 of the discharge electrode 6, disposed opposite the heat-generating body 5 via the heat generation portion insulating film 5*a* covered on the upper surface of the heat-generating body 5, to which voltage is applied, is selectively heated, and discharge can be generated from the discharge portion 9.

(2) By heating an optional individual discharge electrode portion 8 of the discharge electrode 6, to which high voltage is applied, by means of the heat-generating body 5 of the heating portion 2, thermoelectrons are emitted from the discharge portion 9 of the selectively heated individual discharge electrode portion 8, and discharge is caused to occur, wherein it is possible to project ions in an atmosphere where ions can be generated. Further, in an atmosphere of an inactive gas such as Xenon gas or neon gas, which permits to generate only a slight amount of ions, a plasma state is brought about when discharge occurs, wherein ultraviolet rays can be projected. In a vacuum state where no ions are generated, thermoelectrons can be emitted as an electron gun.

(3) By covering the heat generation portion insulating film 5*a* on at least the upper surface of the heat-generating body 5, the discharge electrode 6, to which high voltage is applied, and the heat-generating body 5 can be insulated from each other, and at the same time, heat emitted from the heat-generating body 5 is transmitted to the discharge electrode 6 side, wherein discharge can be generated from the discharge portion 9 by heating an optional individual discharge electrode portion 8 of the discharge electrode 6 opposed to the heat-generating body 5 that generates heat.

(4) Since the one-sided ends of a plurality of individual discharge electrode portions 8 are connected by the common electrode portion 7, it is possible to simultaneously apply voltage to a plurality of individual discharge electrode portions 8 via the common electrode portion 7.

(5) By controlling the heating time of the discharge electrode 6 by the heat-generating body 5 of the heating portion 2, it is possible to control the discharge time at the discharge portion 9 of the discharge electrode 6.

(6) Since the amount of generation of ions can be controlled only by controlling the heating time to the discharge electrode 6 by the heating portion 2, it is possible to easily carry out area gradation on an image carrier, to which ions are projected, in an image forming apparatus of an electrostatic latent image forming system, wherein the image quality can be improved.

Since the method for controlling discharge of a discharge control unit according to Embodiment 1 is constructed as described above, the following actions are included.

(1) By carrying out multi-divided discharge control by which heating of the discharge electrode 6 by the heating portion 2 is divided into a plurality of times and is repeated, the number of rises in which the discharge amount is increased can be increased, wherein it is possible to increase the amount of projection of ions and ultraviolet rays as a whole.

(2) By controlling the number of partitions of heating when carrying out multi-divided discharge control, it is possible to control the amount of projection of ions and ultraviolet rays, wherein it is possible to carry out area gradation and concentration gradation on an image carrier, to which ions are projected, in an image forming apparatus of an electrostatic latent image forming system.

(3) Since the amount of projection of ions and ultraviolet rays can be increased by increasing the number of times of discharge while carrying out multi-divided discharge control, it is possible to set the application voltage per time to a lower level, and the discharge time can be shortened, wherein an excellent long service life of the discharge electrode 6 can be secured.

(4) It is possible to control the amount of projection of electrons, ions, and ultraviolet rays by controlling the turning-on time of the heat-generating body 5 per time and the number of times of repetition. In particular, where the discharge control unit 1 is applied to an image forming apparatus of an ion projecting system, it is possible to carry out area gradation and concentration gradation on an image carrier to which ions are projected.

(5) Since, in the step of preheating a discharge electrode, response to ON and OFF of an electric current to the heat-generating body 5 of the heating portion 2 can be secured by preheating at least the discharge electrode 6 without being adversely influenced by the ambient temperature, a stabilized action can be obtained immediately after start. In particular, stabilized printing quality can be obtained since the commencement of printing in an image forming apparatus, wherein excellent reliability can be secured.

(6) Since it is possible to extract moisture adhered to the discharge electrode 6 and the peripheries thereof by the step of preheating discharge electrodes, excellent discharge stability is secured.

Since the method for producing the discharge control unit according to Embodiment 1 is constructed as described above, the method includes the following actions.

(1) It is possible to easily produce the discharge control unit 1 only by adding the step of forming a heat generation portion insulating film 5*a* which is an insulator and the step of forming the discharge electrode 6 on the heat generation portion insulating film 5*a* to the process of producing the heating portion such as the existing thermal print head.

(2) It is possible to securely insulate the discharge electrode 6 and the heat-generating body 5 of the heating portion 2 by forming the heat generation portion insulating film 5*a* on at least the upper surface of the heat-generating body 5 in the step of forming a heat generation portion insulating film.

EMBODIMENT 2

With reference to the drawings, a description is given below of a discharge control unit and a method for producing the same according to Embodiment 2 of the invention.

Figure 9A:
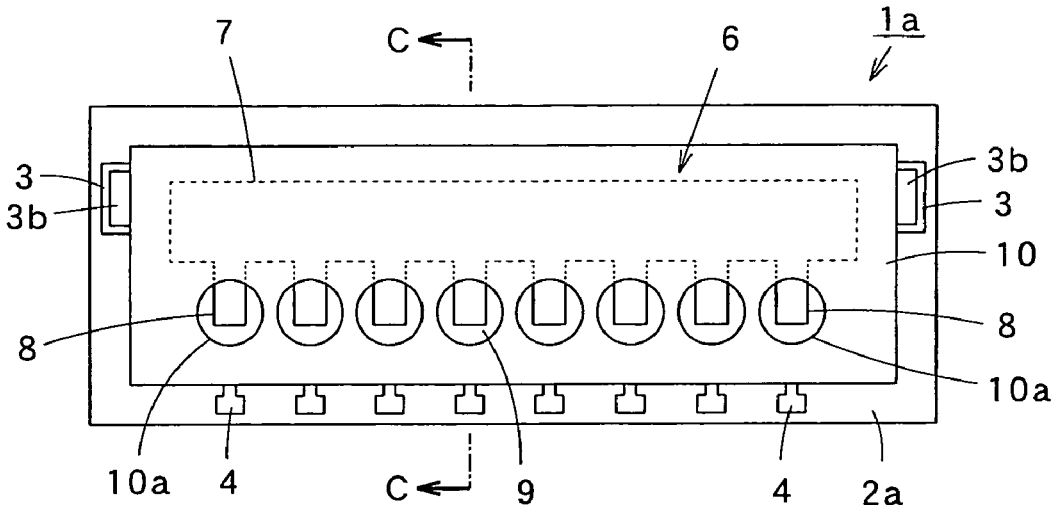
FIG. 9A is a schematic plan view showing a discharge control unit according to Embodiment 2 of the invention.
Figure 9B:
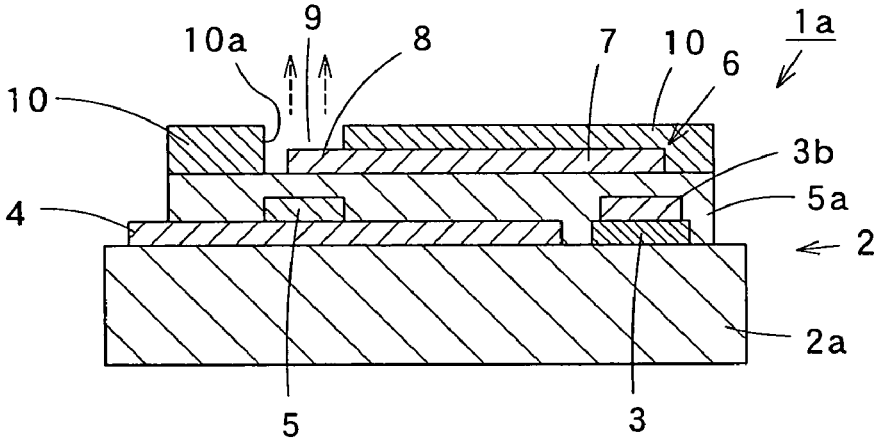
FIG. 9B is a sectional view taken along the line C-C in FIG. 9A.
Figure 10A:
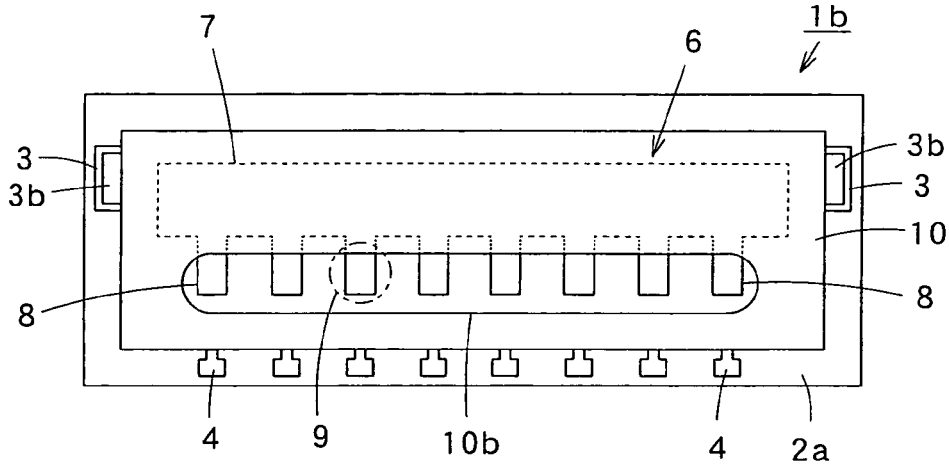
FIG. 10A is a schematic plan view showing the first modified version of a discharge control unit according to Embodiment 2 of the invention.
Figure 10B:
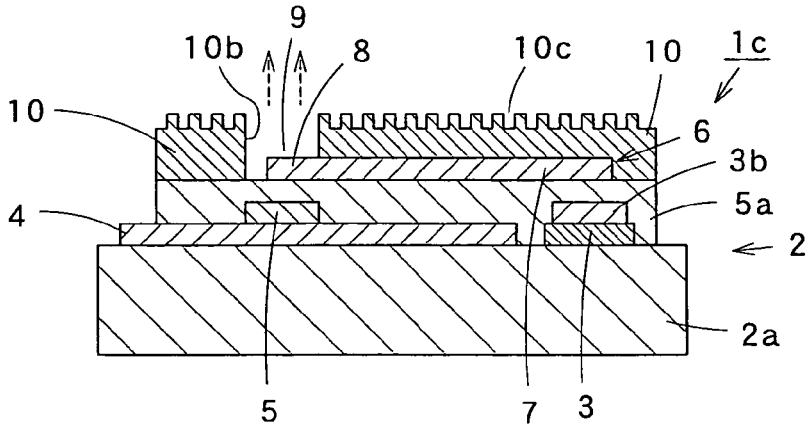
FIG. 10B is a schematic plan view showing the second modified version of the discharge control unit according to Embodiment 2 of the invention.

FIG. 9A is a schematic plan view showing a discharge control unit according to Embodiment 2 of the invention, FIG. 9B is a sectional view taken along the line C-C in FIG. 9A, FIG. 10A is a schematic plan view showing the first modified version of a discharge control unit according to Embodiment 2 of the invention, and FIG. 10B is a schematic plan view showing the second modified version of the discharge control unit according to Embodiment 2 of the invention.

In FIG. 9, the discharge control unit 1*a* according to Embodiment 2 of the invention differs from Embodiment 1 only in that a coating film 10 is covered on the upper surface of the discharge electrode 6, and the coating film 10 has roughly circular openings 10*a* at the tip end portions corresponding to the discharge portions 9 (the vicinity of the position of the heat-generating body 5) of respective individual discharge electrode portions 8.

The coating film 10 was formed of an insulative body similar to the above-described heat generation portion insulating film 5*a*.

A discharge control unit 1*b* according to the first modified version of FIG. 10A differs from Embodiment 2 in that an opening 10*b* of the coating film 10 covered on the upper surface of the discharge electrode 6 is formed to be a long slot common to a plurality of individual discharge electrode portions 8.

A discharge control unit 1*c* according to the second modified version of FIG. 10B differs from Embodiment 2 in that recesses and projections 10*c* are formed on the surface of the coating film 10 covered on the upper surface of the discharge electrode 6.

A method for producing the discharge control unit according to Embodiment 2 differs from Embodiment 1 in that the step of forming a discharge electrode includes a step of forming a coating film. All others are identical to those of Embodiment 1. Therefore, the description is omitted.

Screen-printing, evaporation or spattering may be preferably employed for the step of forming a coating film. By forming a pattern so that the discharge portion 9 of the individual discharge electrode portion 8 of the discharge electrode 6 can be opened, it is possible to easily and securely coat parts other than the discharge portion 9.

Also, since the recesses and projections 10*c* on the surface of the coating film 10 can be easily formed by screen-printing, etc., the presence or absence of the recesses and projections 10*c* does not make cumbersome the step of forming a coating film, wherein excellent mass productivity can be secured.

Since the discharge control unit according to Embodiment 2 is constructed as described above, the following actions are included in addition the actions of Embodiment 1.

(1) Since the coating film 10 covered on the upper surface of the discharge electrode 6 excepting the discharge portion 9 is provided, it is possible to prevent discharge from occurring from excess points other than the discharge portion 9 of the individual discharge electrode portions 8, and it is possible to concentrate ions and ultraviolet rays to one point and project thereto, wherein excellent efficiency is secured.

(2) Since, by forming the coating film 10 excepting the discharge portion 9 of the individual discharge electrode portion 8, a stage difference can be formed between the surface of the discharge portion 9 of the individual discharge electrode portion 8 and the surface of the coating film 10, it is possible to keep constant the stage difference between the discharge electrode 6 and the image carrier (a carrier of an electrostatic latent image, such as electrostatic recording paper, etc.) disposed opposite thereto, and it is possible to prevent the discharge portion 9 and the image carrier, etc., from being brought into contact with each other, wherein discharge from the discharge portion 9 can be stabilized.

(3) By forming recesses and projections 10*c* on the surface of the coating film 10, the surface distance of the coating film 10 can be elongated and the surface resistance can be increased, wherein it is possible to simply prevent electric leakage from occurring from the discharge portion 9 of the individual discharge electrode portion 8 to its peripheries.

Since the method for producing the discharge control unit according to Embodiment 2 is constructed as described above, the following action is included in addition to the actions of Embodiment 1.

(1) Since the step of forming a discharge electrode includes a step of forming a coating film, the coating film 10 is covered on the discharge electrode 6, excepting the discharge portion 9, and a stage difference to protect the discharge portion 9 can be formed between the surface of the discharge portion 9 of the individual discharge electrode portion 8 and the surface of the coating film 10.

EMBODIMENT 3

A description is given below of a discharge control unit according to Embodiment 3 with reference to the drawing.

Figure 11:
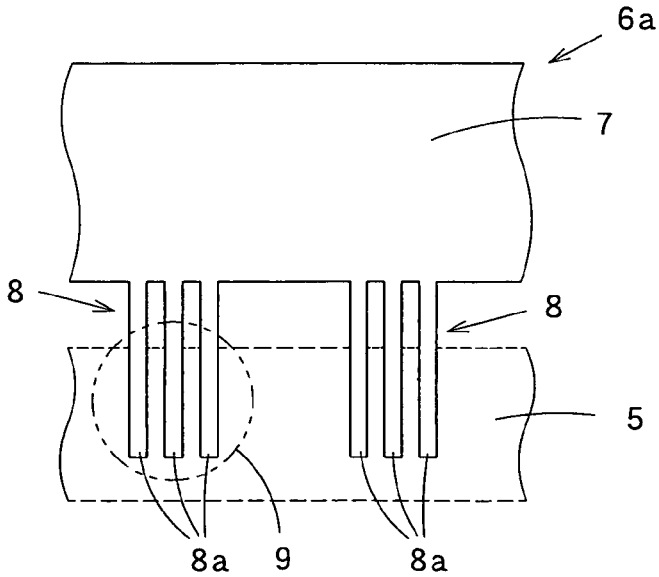
FIG. 11 is a schematic plan view of the major parts showing discharge electrodes of a discharge control unit according to Embodiment 3 of the invention.

FIG. 11 is a schematic plan view of the major parts showing discharge electrodes of a discharge control unit according to Embodiment 3 of the invention.

In FIG. 11, the discharge electrode 6*a* of the discharge control unit according to Embodiment 3 of the invention differs from that of Embodiment 1 in that the individual discharge electrode portion 8 of the discharge electrode 6*a* is provided with split electrodes 8*a* formed to be divided into a plurality by means of slits.

It is possible to easily form the split electrodes 8*a* simultaneously with the individual discharge electrode 8 only by changing the pattern of a mask without increasing any process. The total of the outer circumferential lengths of the respective split electrodes 8*a* is increased to a larger extent than the outer circumferential length of a non-divided individual discharge electrode portion 8, wherein the discharge amount from the edge peripheries, where the discharge amount is great, can be efficiently increased. Thereby, it is possible to set the application voltage applied to the discharge electrode 6 to a lower level, wherein a longer service life of the discharge electrode 6 can be secured.

Also, in the present embodiment, the slits are formed in parallel to the lengthwise direction of the individual discharge electrode portion 8. However, the slits may be formed in the direction orthogonal to the lengthwise direction thereof. In addition, the split electrodes 8*a* are formed by dividing the entirety of the individual discharge electrode portion 8*a*. However, the split electrodes 8*a* may be formed by partially dividing the edges of the individual discharge electrode portion 8. The method for dividing the individual discharge electrode portion 8 is not limited to slits, any method may be acceptable if a plurality of split electrodes 8*a* can be formed. For example, where one or more individual discharge pore portions is (are) provided in the individual discharge electrode portion 8, discharge is generated from the edge periphery of the individual discharge pore portion, wherein energy-saving performance can be improved.

The method for producing the discharge control unit according to Embodiment 3 is similar to that of Embodiment 1. Therefore, the description thereof is omitted.

Since the discharge control unit according to Embodiment 3 is constructed as described above, the following action is included in addition to the actions of Embodiment 1.

(1) By dividing the individual discharge electrode portion 8 of the discharge electrode 6 by means of slits and forming a plurality of split electrodes 8*a*, the outer circumferential lengths of the individual discharge electrode portion 8 can be lengthened, wherein it is possible to increase the discharge amount from the edge periphery of the individual discharge electrode portion 8, the amount of projection of ions and ultraviolet rays can be increased, and excellent energy saving performance can be brought about.

EMBODIMENT 4

A description is given below of a discharge control unit according to the present embodiment 4 of the invention with reference to the drawing.

Figure 12A:
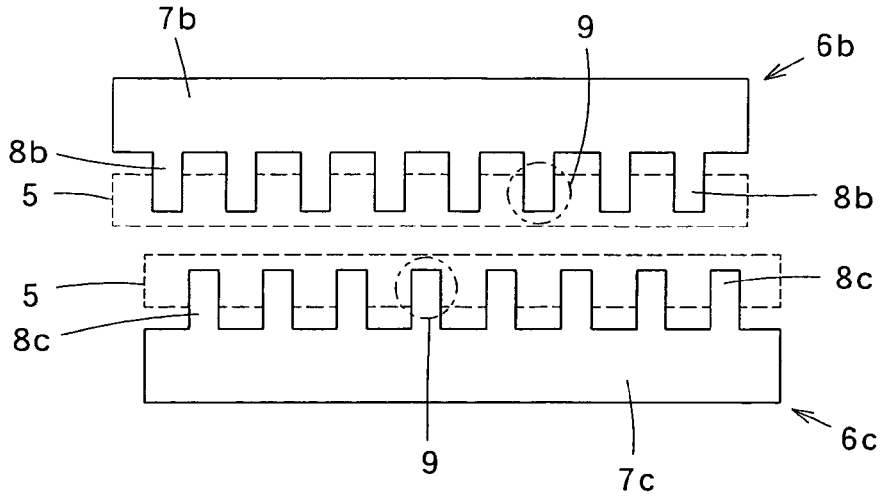
FIG. 12A is a schematic plan view of the major parts showing discharge electrodes of a discharge control unit according to Embodiment 4 of the invention.
Figure 12B:
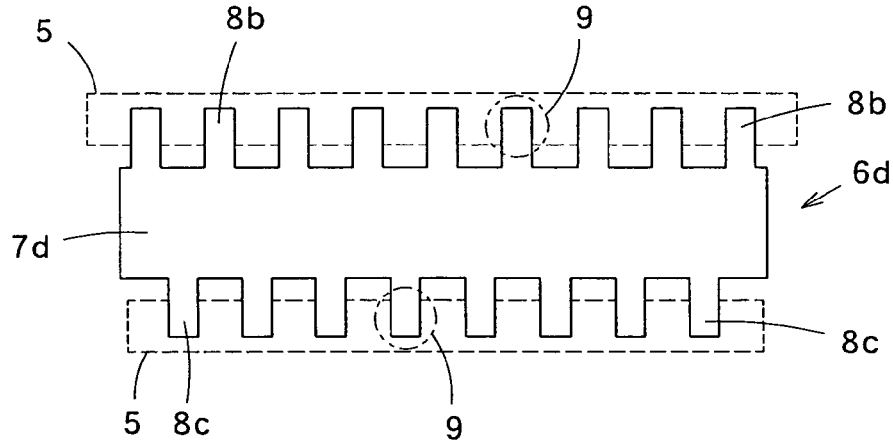
FIG. 12B is a schematic plan view of the major parts showing discharge electrodes of the discharge control unit according to Embodiment 4 of the invention.

FIG. 12A is a schematic plan view of the major parts showing discharge electrodes of a discharge control unit according to Embodiment 4 of the invention, and FIG. 12B is a schematic plan view of the major parts showing a modified version of discharge electrodes of the discharge control unit according to Embodiment 4 of the invention.

In FIG. 12A, the discharge control unit according to Embodiment 4 of the invention differs from Embodiment 1 in that comb teeth-shaped discharge electrodes 6*b* having one-sided ends of a plurality of individual discharge electrode portions 8*b* connected by means of the common electrode portion 7*b* and comb teeth-shaped discharge electrodes 6*c* having one-sided ends of a plurality of individual discharge electrode portions 8*c* connected by means of the common electrode portion 7*c* are disposed opposite each other in chessboard patterns.

By two discharge electrodes 6*b* and 6*c* formed with the same basic pitch while being slipped by one-half the basic pitch, the minimum pitch (pitch between the individual discharge electrode portions 8*b* and 8*c*) can be made into one-half the basic pitch, wherein the entire resolution can be improved. A plurality of rows of common electrode portions 7 and 7*c*, which are juxtaposed to each other, may be made independent from each other as shown in FIG. 12, or may be connected to each other in the channel-shaped form by connecting one-sided ends thereof together.

Since a plurality of individual discharge electrode portions 8*b* and 8*c* can be formed with the same pitch, wherein the processing can be facilitated, excellent mass productivity can be brought about, and the yield can be improved.

Further, in the present embodiment, two rows of individual discharge electrode portions 8*b* and 8*c* are disposed in chessboard patterns. However, it is possible to discharge n rows of individual discharge electrode portions while being slipped by 1/n the basic pitch.

In FIG. 12B, the discharge electrode of the discharge control unit according to a modified version differs from Embodiment 1 in that a plurality of individual discharge electrode portions 8*b* and 8*c* are disposed at both sides of one common electrode portion 7*d* of the discharge electrode 6*d* in chessboard patterns opposite each other.

The chessboard arrangement may be such that, as shown in FIG. 12A, a plurality of individual discharge electrode portions 8*b* and 8*c* respectively connected by one common electrode portion 7*b* and 7*c* are made into one-row unit and are juxtaposed in a plurality of rows, and may be such that one row of a plurality of individual discharge electrode portions 8*b* and 8*c* are formed at both sides of one common electrode portion 7*d* as shown in FIG. 12B.

Further, by inclining and disposing the entire rows of the individual discharge electrode portions formed with the basic pitch, the pitch of the individual discharge electrode portions in the array direction, which are projected on the horizontal plane, can be made narrower than the basic pitch, wherein it is possible to mount at a higher density without any limitation in processing.

Still further, since the method for producing the discharge control unit according to Embodiment 4 is identical to Embodiment 1, the description thereof is omitted.

Since the discharge control unit according to Embodiment 4 is constructed as described above, the following action is included in addition to the actions of Embodiment 1.

(1) By disposing a plurality of individual discharge electrode portions 8*b* and 8*c* in chessboard patterns, it is possible to narrow the minimum pitch by interpolation by means of a plurality of rows of individual discharge electrode portions adjacent to each other without changing the basic pitch of the respective individual discharge electrode portions 8*b* and 8*c* formed in the same row. Therefore, it is possible to mount a plurality of individual discharge electrode portions 8*b* and 8*c* substantially at high density, wherein the entire resolution can be improved.

EMBODIMENT 5

A description is given below of a discharge control unit and a method for producing the same according to Embodiment 5 with reference to the drawings.

Figure 13:
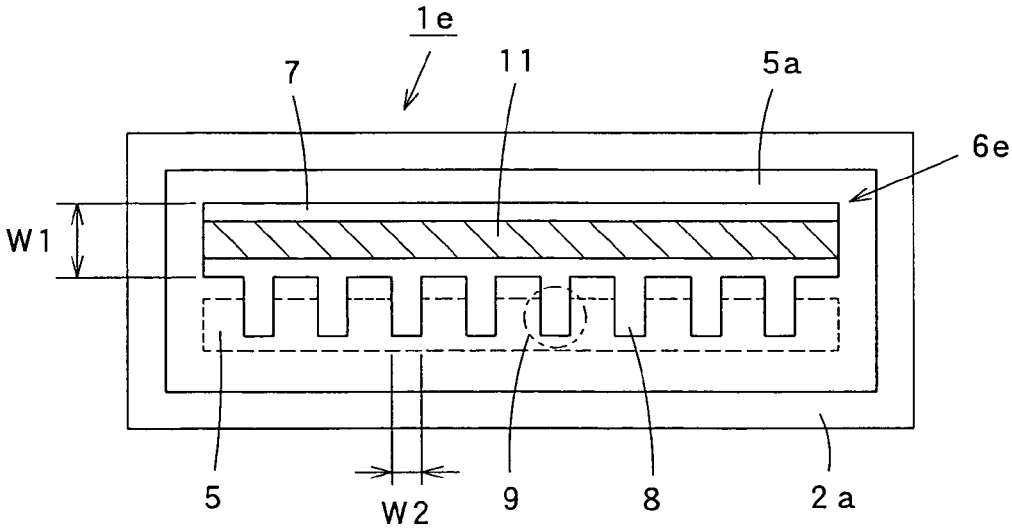
FIG. 13 is a schematic plan view of the major parts showing a discharge control unit according to Embodiment 5 of the invention.
Figure 14:
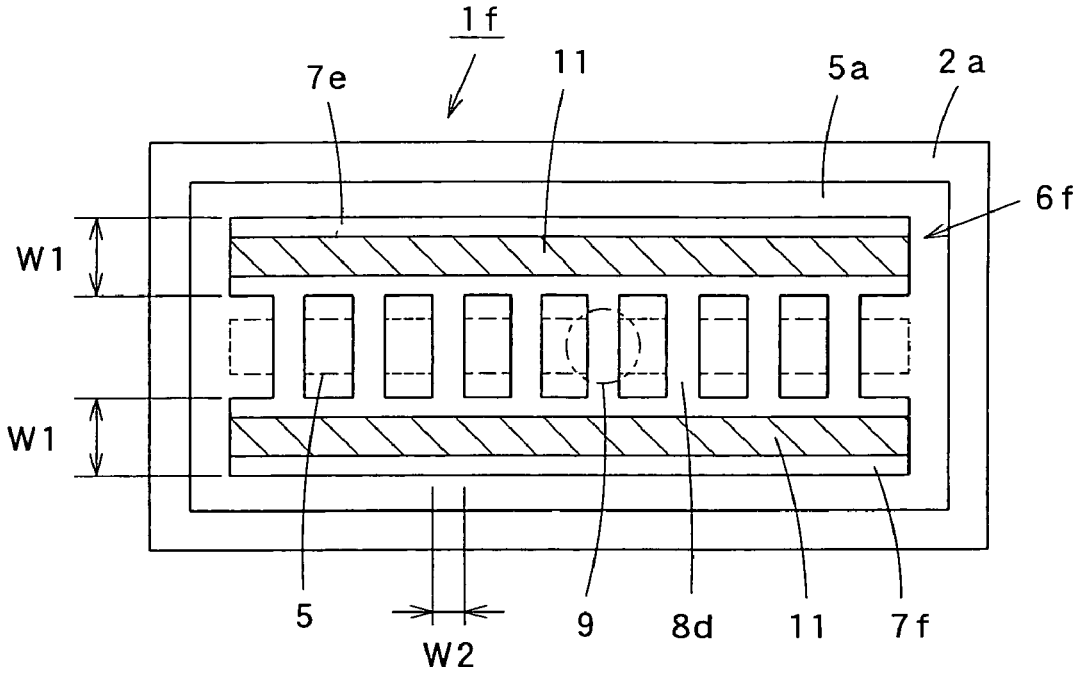
FIG. 14 is a schematic plan view of the major parts showing a modified version of the discharge control unit according to Embodiment 5 of the invention.

FIG. 13 is a schematic plan view of the major parts showing a discharge control unit according to Embodiment 5 of the invention, and FIG. 14 is a schematic plan view of the major parts showing a modified version of the discharge control unit according to Embodiment 5 of the invention.

In FIG. 13, the discharge control unit 1*e* according to Embodiment 5 of the present invention differs from Embodiment 1 in that a conductive material layer 11 is formed on the surface of the common electrode portion 7 of the discharge electrode 6*e*.

Also, for convenience of the description, it is assumed that the common conductor pattern 3, comb teeth-shaped pattern portion 3*a*, common electrode 3*b* for heat generation, and individual electrodes 4, which are connected to the heat-generating body 5, are omitted. However, these are formed in the same manner as in Embodiments 1 through 4 of the invention.

The conductive material layer 11 was formed by silver paste or silver plating, etc., which has excellent conductivity.

Also, the width W1 of the common electrode portion 7 was formed to be wider than the width W2 of the individual discharge electrode portion 8.

The width W1 of the common electrode portion 7 can be adequately established in compliance with the width W2 and number of the individual discharge electrode portions 8. Since the common electrode portion 7 can have a sufficient area with respect to the total area of the individual discharge electrode portion 8, influence due to the resistance value of the common electrode portion 7 can be reduced, and it is possible to suppress the potential difference between the individual discharge electrode portions 8.

The discharge control unit 1*f* according to the modified version in FIG. 14 differs from Embodiment 5 in that, in addition to the common electrode portion 7*e* for connecting one-sided portions of a plurality of individual discharge electrodes 8*d*, the discharge electrode 6*f* is provided with an auxiliary common electrode portion 7*f* for connecting the other end portions thereof.

Further, for convenience of description, the common conductor pattern 3, comb teeth-shaped pattern portion 3*a*, common electrode 3*b* for heat generation, and individual electrodes 4, which are connected to the heat-generating body 5, are omitted. However, these are formed in the same manner as in Embodiments 1 through 4 of the invention.

The auxiliary common electrode portion 7*f* supplements a shortage in the area of the common electrode portion 7*e*, and the width W1' thereof may be adequately selected in compliance with the width W1 of the common electrode portion 7*e*, and the width W2 and number of the individual discharge electrode portions 8*d*. In addition, the common electrode portion 7*e* and the auxiliary common electrode portion 7*f* may be made independent as shown in FIG. 14 or one end or both ends thereof may be connected together.

The method for producing the discharge control unit according to Embodiment 5 differs from Embodiment 1 in that the step of forming a discharge electrode includes a step of forming a conductive material layer. The other parts thereof are the same as Embodiment 1, and description thereof is omitted.

By forming the conductive material layer 11 on the surface of the common electrode portion 7*e* and the auxiliary common electrode portion 7*f* by the step of forming a conductive material layer, it is possible to reduce the resistance value of the common electrode 7*e* and the auxiliary common electrode portion 7*f*, wherein it is possible to securely reduce the potential difference occurring between the respective individual discharge electrode portions 8.

Also, in the present embodiment, although a conductive material layer 11 is formed on both of the common electrode portion 7*e* and the auxiliary common electrode portion 7*f*, the layer may be formed only on either one thereof. The conductive material layer 11 may be formed on a part of the common electrode portion 7*e* and the auxiliary common electrode portion 7*f* as shown in FIG. 13 and FIG. 14, or may be formed on the entire width thereof. Also, the conductive material layer 11 may be not only single but also may be formed like a plurality of bands by dividing the same into two or more. Furthermore, the conductive material layer 11 may be formed at parts other than the discharge portion 9 of the individual discharge electrode portion 8*d*.

Since the discharge control unit according to Embodiment 5 is constructed as described above, the following actions are included in addition to the actions of Embodiment 1.

(1) By forming the conductive material layer 11 on the surface of the common electrode portion 7, it is possible to further reduce the resistance value of the common electrode portion 7, and it is possible to securely reduce the potential difference occurring between the respective individual discharge electrode portions 8, wherein excellent discharge stability can be brought about.

(2) Since the discharge electrode 6*f* is provided with the auxiliary common electrode portion 7*f* for connecting the other end portions of a plurality of individual discharge electrode portions 8*d*, the cooling effect of the individual discharge electrode portion 8*d* by enlargement of a radiation area combined with the common electrode portion 7*e*, responsiveness to turning-off of heating, stability in discharge based on a decrease in the resistance value, etc., can be further improved.

Since the method for producing the discharge control unit according to Embodiment 5 is constructed as described above, the following action is included in addition to the actions of Embodiment 1.

(1) Since the step of forming a discharge electrode includes a step of forming a conductive material layer, it is possible to easily form a conductive material layer 11 on the surface of the common electrode portion 7 of the discharge electrode 6*e*, wherein it is possible to reduce the resistance value of the common electrode portion 7.

EMBODIMENT 6

A description is given below of a discharge control unit and a method for producing the same according to Embodiment 6 with reference to the drawing.

Figure 15:
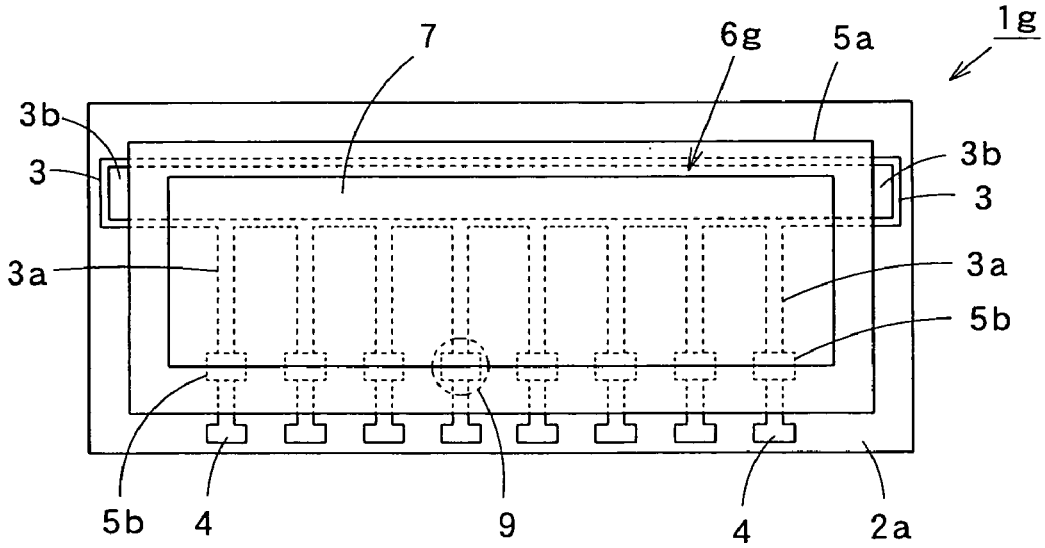
FIG. 15 is a schematic plan view showing a discharge control unit according to Embodiment 6 of the invention.

FIG. 15 is a schematic plan view showing a discharge control unit according to Embodiment 6 of the invention.

In FIG. 15, the discharge control unit 1*g* according to Embodiment 6 of the invention differs from Embodiment 1 in that the discharge electrode 6*g* is formed to be like a flat rectangular plate and a plurality of heat-generating bodies 5*b* electrically connected to the comb teeth-shaped pattern portions 3*a* and the individual electrodes 4, respectively, are disposed with a predetermined interval so as to be stretched over the edge portion of the discharge electrode 6*g*.

By disposing the heat-generating bodies 5*b* so as to be stretched over the edge portion of the discharge electrode 6*g* where the discharge amount is great, it becomes easier for discharge to occur from the discharge portion 9 at the edge portion of the discharge electrode 6*g*.

By selectively heating a plurality of heat-generating bodies 5*b*, it is possible to selectively cause discharge to be generated from an optional discharge portion 9 of the discharge electrode 6*g* corresponding to the positions of the heat-generating bodies 5*b* and to control the discharge. Since the pitch of the discharge portion 9 is regulated by the pitch of the heat-generating bodies 5*b* (comb teeth-shaped pattern portion 3*a* and individual electrode 4), the pitch of the discharge portion 9 can be made small if mounting is carried out at a high density by making minute the pitches of the comb teeth-shaped pattern portions 3*a* and the individual electrodes 4, wherein high resolution images can be formed if the discharge control unit 1*g* is used as a print head of an image forming apparatus. In addition, since it is possible to easily change the resolution only by changing the pitch of the electrode pattern (comb teeth-shaped pattern portions 3*a* and individual electrodes 4), wherein the freedom in design is superior, and since the pitch of the discharge portions 9 is regulated by the pitch of the heat-generating bodies 5*b* (comb teeth-shaped pattern portions 3*a* and individual electrodes 4), no minute positioning is required when forming the discharge electrodes 6*g*, wherein excellent productivity can be secured.

Also, in the present embodiment, a plurality of heat-generating bodies 5*b* are disposed only in one row so as to be stretched over the edge portion at one side of the discharge electrode 6*g*. However, two rows of heat-generating bodies 5*b* may be disposed so as to be stretched over two sides, opposed to each other, of the discharge electrode 6*g* by taking out the comb teeth-shaped pattern portions 3*a* from both sides of the common conductor pattern 3 with the common conductor pattern 3 formed at the middle of the discharge electrode 6*g*. At this time, by disposing two rows of heat-generating bodies 5*b* in chessboard patterns, it is possible to mount the heat-generating bodies 5*b* at high density and an image of high resolution can be obtained in the image forming apparatus.

The method for producing the discharge control unit according to Embodiment 6 differs from Embodiment 1 in that there is no need to form the common electrode portion 7 and a plurality of individual discharge electrode portions 8, using patterns, in the step of forming discharge electrodes, wherein it is possible to easily form discharge electrodes 6*g* by contact print. And, the other parts thereof are identical to those of Embodiment 1, wherein description thereof is omitted.

Since the discharge control unit according to Embodiment 6 is constructed as described above, the following actions are included in addition to the actions of Embodiment 1.

(1) Since discharge can be generated from an optional discharge portion 9 of the discharge electrode 6*g* selectively heated by a plurality of heat-generating bodies 5*b*, it is possible to form the discharge electrode 6*g* in the form of a flat rectangular or square plate, wherein excellent productivity is brought about.

(2) Since the heat-generating bodies 5*b* are disposed so as to be stretched over the edge portion of the discharge electrode 6*g* formed to be like a flat rectangular or square plate, it is possible to cause discharge to be efficiently generated from the edge portion of the discharge portion 9 where the discharge amount is great.

Since the method for producing the discharge control unit according to Embodiment 6 is constructed as described above, the following action is included in addition to the actions of Embodiment 1.

(1) There is no need to form the common electrode portion 7 and a plurality of individual discharge electrode portions 8, using a pattern, in the step of forming discharge electrodes, and it is possible to easily form the discharge electrode 6*g* by contact print. Further, no minute positioning is required with respect to the heat-generating bodies 5*b*, wherein excellent mass productivity is secured.

EMBODIMENT 7

A description is given below of a discharge control unit and a method for producing the same according to Embodiment 7 of the invention with reference to the drawings.

Figure 16A:
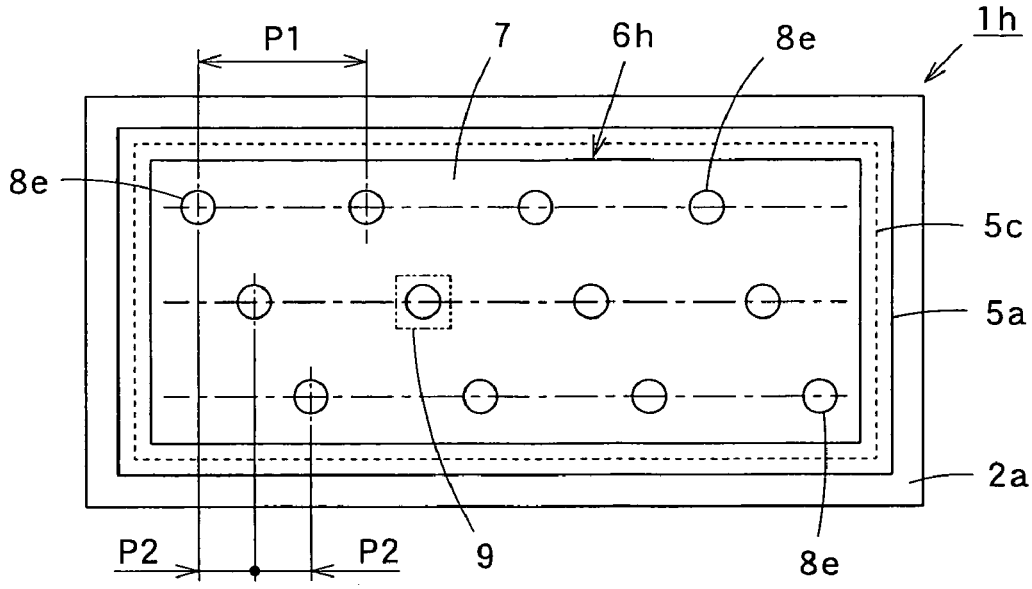
FIG. 16A is a schematic plan view of the major parts showing a discharge control unit according to Embodiment 7 of the invention.
Figure 16B:
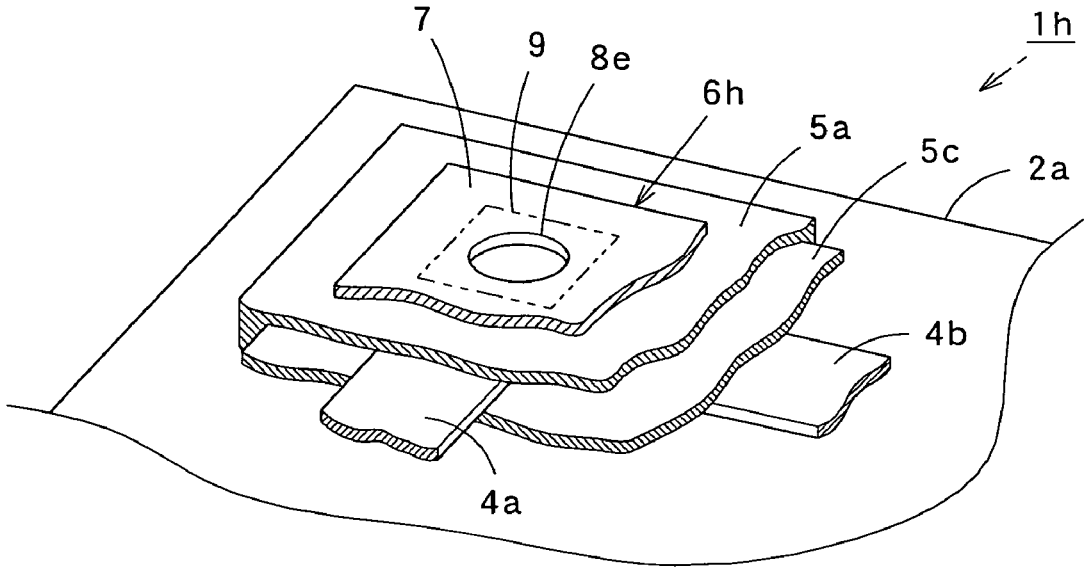
FIG. 16B is a schematic broken perspective view of the major parts, showing the structure of the discharge control unit according to Embodiment 7 of the invention.

FIG. 16(*a*) is a schematic plan view of the major parts showing a discharge control unit according to Embodiment 7 of the invention, and FIG. 16(*b*) is a schematic broken perspective view of the major parts, showing the structure of the discharge control unit according to Embodiment 7 of the invention.

In FIG. 16, the discharge control unit 1*h* according to Embodiment 7 of the invention differs from Embodiment 1 in that a rectangular heat-generating body 5*c* is formed to correspond to the entire surface of a discharge electrode 6*h* formed to be like a flat rectangular plate, a plurality of individual discharge pore portions 8*e* arrayed in chessboard patterns are formed in the discharge electrode 6*h* instead of the individual discharge electrode portion 8, and matrix electrodes 4*a* and 4*b* are formed, which cross at positions corresponding to the respective individual discharge pore portions 8*e*, selectively causes an electric current to flow to the vicinity of the respective individual discharge pore portions 8*e* and heat the discharge portions 9.

Since the individual discharge pore portions 8*e* are formed so as to correspond to the discharge portions (heating positions) of the heat-generating body 5*c*, discharge easily occurs from the edge peripheries of the individual discharge pore portions 8*e*, and actions similar to those of the individual discharge electrode portions can be obtained. In addition, the outer diameter of the individual discharge pore portion 8*e* was formed so as to become smaller than the width of the electrode 4*a* or 4*b*. Therefore, the peripheral portions of the individual discharge pore portions 8*e* of the discharge electrode 6*h* can be securely heated, and it is possible to generate discharge from the discharge portion 9.

Further, since three rows of the individual discharge pore portions 8*e* formed with the same basic pitch P1 are disposed while being slipped by P2 equivalent to one-third the basic pitch P1, the minimum pitch P2 can be made into one-third the basic pitch P1, wherein the entire mounting density can be improved.

Also, in the present embodiment, the individual discharge pore portions 8*e* are shaped to be roughly circular. However, the individual discharge pore portions 8*e* may be shaped to be roughly elliptical, polygonal, such as square, hexagonal, or to be star-like. In addition, the number and size of the individual discharge pore portions 8*e* per discharge portion 9 may be adequately selected and combined. Where a plurality of individual discharge pore portions 8*e* are formed, it is possible to efficiently increase the discharge amount from the peripheral portions of the individual discharge pore portions 8*e*, when heating the discharge portions 9, by distributing the individual discharge pore portions 8*e* in the range of the width of electrodes 4*a* and 4*b*. Further, the heat-generating bodies 5*c* are divided into a plurality, corresponding to the positions of the discharge portions 9 (individual discharge pore portions 8*e*) and are disposed in chessboard patterns, and are electrically connected to each other.

The method for producing the discharge control unit according to Embodiment 7 differs from Embodiment 1 in that, in the step of forming discharge electrodes, the individual discharge pore portions 8*e* are formed, using a pattern, instead of the common electrode portion 7 and a plurality of individual discharge electrode portions 8, wherein there is a difference in the mask, but no difference in terms of the processes. Also, the other portions are identical to those of Embodiment 1, and the description thereof is omitted.

Since the discharge control unit according to Embodiment 7 is constructed as described above, the following actions are included in addition to the actions of Embodiment 1.

(1) It is possible to selectively heat the vicinity of a plurality of individual discharge pore portions 8*e* formed on the discharge electrode 6*h* by means of the heat-generating bodies 5*c*, and it is possible to efficiently cause discharge to be generated from the edge peripheries of an optional individual discharge pore portion 8*e*.

(2) A plurality of individual discharge pore portions 8*e* are disposed in chessboard patterns, and the heat-generating bodies 5*c* are electrically connected to each other by means of the electrodes 4*a* and 4*b* formed in the form of a matrix, and optional positions thereof can be selectively heated, and control can be carried out by selectively causing discharge to be generated from a plurality of discharge portions 9 corresponding thereto, wherein it is possible to simply aim at improving the resolution and recording speed in an image forming apparatus.

Since the method for producing the discharge control unit according to Embodiment 7 is constructed as described above, the following action is included in addition to those of Embodiment 1.

(1) A plurality of individual discharge pore portions 8*e* can be easily formed, using a pattern, in the step of forming discharge electrodes, and it is possible to increase the discharge amount in the discharge portion 9 corresponding to a heating point of the heat-generating body 5*c* without increasing consumption energy.

EMBODIMENT 8

A description is given below of a discharge control unit and a method for producing the same according to Embodiment 8 with reference to the drawings.

Figure 17A:
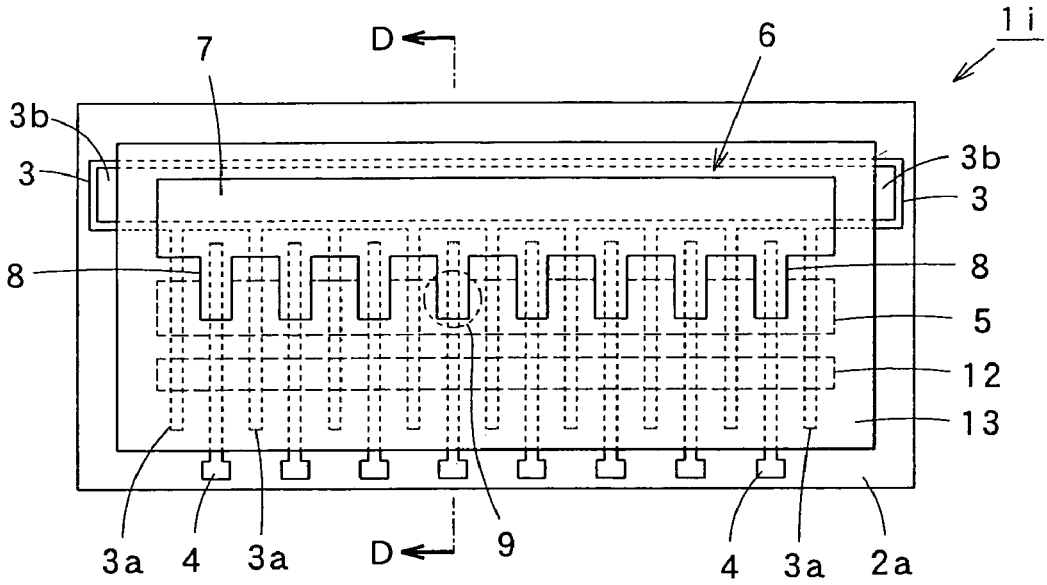
FIG. 17A is a schematic plan view showing a discharge control unit according to Embodiment 8 of the invention.
Figure 17B:
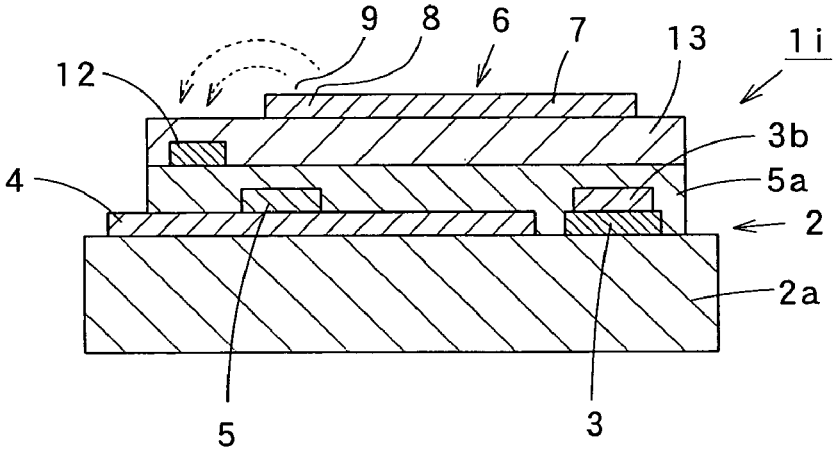
FIG. 17B is a sectional view taken along the line D-D in FIG. 17A.

FIG. 17A is a schematic plan view showing a discharge control unit according to Embodiment 8 of the invention, and FIG. 17B is a sectional view taken along the line D-D in FIG. 17A.

In FIG. 17, the discharge control unit 1*i* according to Embodiment 8 of the invention differs from Embodiment 1 in that the induction electrode 12 is spaced from the end portion at the heat-generating body 5 side of the discharge electrode in the horizontal direction and is formed on the heat generation portion insulating film 5*a*, and the induction electrode insulating film 13 which covers the induction electrode 12 is formed between the discharge electrode 6 and the heat generation portion insulating film 5*a*.

The method for producing the discharge control unit according to Embodiment 8 differs from Embodiment 1 in that the step of forming an induction electrode and the step of forming an induction electrode insulating film are provided between the step of forming a heat generation portion insulating film and the step of forming a discharge electrode. The other portions are identical to those of Embodiment 1, and the description thereof is omitted.

After the step of forming a heat generation portion insulating film, the induction electrode 12 is spaced in the horizontal direction from the end portion at the heat-generating body 5 side of the discharge electrode 6 formed in a subsequent step, which is a step of forming a discharge electrode, and is formed on the upper surface of the heat generation portion insulating film 5*a*.

Next, after the induction electrode insulating film 13 that covers the induction electrode 12 is formed on the upper surface of the heat generation portion insulating film 5*a*, the discharge electrode 6 is formed on the upper surface of the induction electrode insulating film 13 in the step of forming discharge electrodes as described above.

Glass, ceramic, mica, resin, etc., may be used as the material of the induction electrode insulating film 13, and the step of forming an induction electrode insulating film was carried out by screen-printing, evaporation, spattering, etc.

The induction electrode 12 was formed to be like a band on the heat generation portion insulating film 5*a* and was grounded. Although discharge occurs so as to be induced by the induction electrode 12, ions and ultraviolet rays are projected toward an objective such as an image carrier as in the case where no induction electrode 12 is provided.

Also, although, in the present embodiment, the induction electrode insulating film 13 was formed on almost the entire surface of the heat generation portion insulating film 5*a*, and the discharge electrode 6 was formed on the induction electrode insulating film 13, the discharge electrode 6 may be formed on the heat generation portion insulating film 5*a* in a state where the insulation electrode insulating film 13 covers only the induction electrode 12, and the induction film 12 may be formed via the induction electrode insulating film 13 on the upper part of the common electrode portion 7 of the discharge electrode 6 formed on the heat generation portion insulating film 5*a*.

Since the discharge control unit according to Embodiment 8 is constructed as described above, the following actions are included in addition to the actions of Embodiment 1.

(1) Since the induction electrode 12 is spaced in the horizontal direction from the end portion at the heat-generating body 5 side of the discharge electrode 6 and is formed on the heat generation portion insulating film 5*a*, it is possible to induce discharge from the discharge electrode 6 to the induction electrode 12, wherein discharge can be securely generated.

(2) Since the induction electrode 12 can be covered with the induction electrode insulating film 13 formed between the discharge electrode 6 and the heat generation portion insulating film 5*a*, the induction electrode 12 can be insulated.

Since the method for producing the discharge control unit according to Embodiment 8 is constructed as described above, the following actions are included in addition to the actions of Embodiment 1.

(1) In the step of forming the induction electrode, the induction electrode 12 to induce discharge from the discharge electrode 6 can be formed on the heat generation portion insulating film 5*a*, being spaced in the horizontal direction from the end portion at the heat-generating body 5 side of the discharge electrode 6.

(2) In the step of forming the induction electrode insulating film, the induction electrode insulating film 13, which covers the induction electrode 12 and insulates the same, can be formed between the discharge electrode 6 and the heat generation portion insulating film 5*a*.

INDUSTRIAL APPLICABILITY

The invention can provide a discharge control unit, which can control discharge from a discharge electrode at low voltage, aim at achieving high density mounting based on downsizing of the discharge control portion and a decrease in production costs, cause electric leakage to hardly occur, and excellent in discharge stability; can provide a method for controlling discharge of the discharge control unit, which can efficiently carry out discharge, is excellent in energy saving performance, and is excellent in the service lives of discharge electrodes; and a method for producing the discharge control unit, which can use the existing production facilities, is excellent in versatility, can simplify the production processes, and is excellent in mass productivity. Using the discharge control unit and the method for controlling discharge thereof, ion projection in an atmosphere where ions can be generated, ultraviolet ray projection in a plasma state in an atmosphere of an inactive gas, and discharge of thermoelectrons in a vacuum state can be controlled, wherein image formation can be carried out on electronic paper, in a plasma display panel (PDP), a field emission display (FED), and vacuum fluorescent display (VFD).

What is claimed is:

1. A discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to said plurality of heat-generating bodies; and a heat generation portion insulating film covered on at least the heat-generating bodies; and a discharge electrode, to which voltage is applied, disposed at the heat generation portion insulating film so as to correspond to one or a plurality of heat-generating bodies;

wherein the discharge electrode is formed to be like a rectangular or square flat plate including a common electrode portion and discharge portions, and discharge is carried out from discharge portions of the discharge electrode selectively heated by the heat-generating bodies.

2. A discharge control unit according to claim 1, wherein the plurality of heat-generating bodies are disposed in chessboard patterns.

3. A discharge control unit according to claim 1, wherein the discharge electrode includes the common electrode portion and the discharge portion and includes a conductive material layer formed on the surface of at least the common electrode portion of the discharge electrode.

4. A discharge control unit according to claim 1, including an electrode protection thin film layer formed on the surface of the discharge electrode.

5. A discharge control unit according to claim 1, including a coating film covered on the discharge electrode other than the discharge portion.

6. A discharge control unit according to claim 5, wherein the discharge control unit includes recesses and projections formed on the surface of the coating film.

7. A discharge control unit according to claim 1, including an induction electrode formed to be spaced from the discharge electrode and to be insulated therefrom.

8. A method for controlling discharge of a discharge control unit according to claim 1, which carries out multi-divided discharge control by dividing heating of the discharge electrode by the heating portion into a plurality of times and repeating the same.

9. A method for controlling discharge of a discharge control unit according to claim 1, including a step of preheating at least the discharge electrode.

10. A discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to a plurality of heat-generating bodies; and a heat generation portion insulating film covered on at least the heat-generating bodies; and discharge electrode, to which voltage is applied, disposed at the heat generation portion insulating film so as to correspond to one or a plurality of heat-generating bodies;

wherein the discharge electrode includes a plurality of individual discharge electrode portions and a common electrode portion formed to be wider than the width of the individual discharge electrode portions, which connects one-sided ends of the plurality of individual discharge electrode portions, and discharge is carried out from discharge portions of the discharge electrode selectively heated by the heat-generating bodies.

11. A discharge control unit according to claim 10, wherein the individual discharge electrode portions of the discharge electrode are provided with split electrodes divided into a plurality.

12. A discharge control unit according to claim 10, wherein the plurality of individual discharge electrode portions are disposed in chessboard patterns.

13. A discharge control unit according to claim 10, wherein the discharge electrode includes an auxiliary common electrode portion for connecting the other end portions of the plurality of individual discharge electrode portions.

14. A discharge control unit according to claim 13, including a conductive material layer formed on the surface of at least the auxiliary common electrode portion of the discharge electrode.

15. A discharge control unit according to claim 10, wherein the plurality of heat-generating bodies are disposed in chessboard patterns.

16. A discharge control unit according to claim 10, wherein the discharge electrode includes the common electrode portion and the discharge portion and includes a conductive material layer formed on the surface of at least the common electrode portion of the discharge electrode.

17. A discharge control unit according to claim 10, including an electrode protection thin film layer formed on the surface of the discharge electrode.

18. A discharge control unit according to claim 10, including a coating film covered on the discharge electrode other than the discharge portion.

19. A discharge control unit according to claim 10, including an induction electrode formed to be spaced from the discharge electrode and to be insulated therefrom.

20. A method for controlling discharge of a discharge control unit according to claim 10, which carries out multi-divided discharge control by dividing heating of the discharge electrode by the heating portion into a plurality of times and repeating the same.

21. A method for controlling discharge of a discharge control unit according to claim 10, including a step of preheating at least the discharge electrode.

22. A method for producing a discharge control unit, the discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to said plurality of heat-generating bodies; and a heat generation portion insulating film covered on at least the heat-generating bodies; and a discharge electrode, to which voltage is applied, disposed at the heat generation portion insulating film so as to correspond to one or a plurality of heat-generating bodies;

wherein the discharge electrode is formed to be like a rectangular or square flat plate including a common electrode portion and discharge portions, and discharge is carried out from discharge portions of the discharge electrode selectively heated by the heat-generating bodies;

the method comprising:

forming the discharge electrode on the heat generation portion insulating film corresponding to a heat-generating body including a step of forming a conductive material layer on the surface of at least the common electrode portion of the discharge electrode.

23. A method for producing a discharge control unit, the discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to a plurality of heat-generating bodies;

a heat generation portion insulating film covered on at least the heat-generating bodies; and a discharge electrode, to which voltage is applied, disposed at the heat generation portion insulating film so as to correspond to one or a plurality of heat-generating bodies;

wherein the discharge electrode includes a plurality of individual discharge electrode portions and a common electrode portion formed to be wider that the width of the individual discharge electrode portions, which connects one-sided ends of the plurality of individual discharge electrode portions, and discharge is carried out from discharge portions of the discharge electrode selectively heated by the heat-generating bodies, and wherein the discharge electrode includes an auxiliary common electrode portion for connecting the other end portions of the plurality of individual discharge electrode portions, the method comprising:

forming the discharge electrode on the heat generation portion insulating film corresponding to a heat-generating body including a step of forming a conductive material layer on the surface of at least the auxiliary common electrode portion of the discharge electrode.

24. A method for producing a discharge control unit, the discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to said plurality of heat-generating bodies; and a heat generation portion insulating film covered on at least the heat-generating bodies; and a discharge electrode, to which voltage is applied, disposed at the heat generation portion insulating film so as to correspond to one or a plurality of heat-generating bodies;

wherein the discharge electrode is formed to be like a rectangular or square flat plate including a common electrode portion and discharge portions, and discharge is carried out from discharge portions of the discharge electrode selectively heated by the heat-generating bodies, the method comprising:

forming the discharge electrode including a step of forming an electrode protection thin film layer on the surface of the discharge electrode.

25. A method for producing a discharge control unit, the discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to said plurality of heat-generating bodies; and a heat generation portion insulating film covered on at least the heat-generating bodies; and a discharge electrode, to which voltage is applied, disposed at the heat generation portion insulating film so as to correspond to one or a plurality of heat-generating bodies;

wherein the discharge electrode is formed to be like a rectangular or square flat plate including a common electrode portion and discharge portions, and discharge is carried out from discharge portions of the discharge electrode selectively heated by the heat-generating bodies, the method comprising:

forming the discharge electrode including a step of forming a coating film covered on the discharge electrodes other than the discharge portions.

26. A method for producing a discharge control unit, the discharge control unit comprising:

a heating portion including one or a plurality of heat-generating bodies and driver ICs electrically connected to one or a plurality of heat-generating bodies and caused to generate heat by flowing an electric current to an optional point of one heat-generating body or selectively flowing the same to said plurality of heat-generating bodies; and a heat generation portion insulating film covered on at least the heat-generating bodies; and a discharge electrode, to which voltage is applied, disposed at the heat generation portion insulating film so as to correspond to one or a plurality of heat-generating bodies;

wherein the discharge electrode is formed to be like a rectangular or square flat plate including a common electrode portion and discharge portions, and discharge is carried out from discharge portions of the discharge electrode selectively heated by the heat-generating bodies, and an induction electrode is formed to be spaced from the discharge electrode and to be insulated therefrom, the method comprising a step of forming the induction electrode on the upper surface of the heat generation portion insulating film, being spaced from the end portion at the heat-generating body side of the discharge electrode in the horizontal direction, and a step of forming an induction electrode insulating film, which covers the induction electrode, on the upper surface of the heat generation portion insulating film.

* * * * *